US009711127B2

(12) United States Patent
Hui et al.

(10) Patent No.: US 9,711,127 B2
(45) Date of Patent: Jul. 18, 2017

(54) MULTI-SENSOR SIGNAL OPTIMIZATION FOR SPEECH COMMUNICATION

(71) Applicants: Siew Kok Hui, Serangoon (SG); Eng Sui Tan, Serangoon (SG)

(72) Inventors: Siew Kok Hui, Serangoon (SG); Eng Sui Tan, Serangoon (SG)

(73) Assignee: BITWAVE PTE LTD., Singapore (SG)

( * ) Notice: Subject to any disclaimer, the term of this patent is extended or adjusted under 35 U.S.C. 154(b) by 447 days.

(21) Appl. No.: 13/621,432

(22) Filed: Sep. 17, 2012

(65) Prior Publication Data

US 2013/0070935 A1 Mar. 21, 2013

Related U.S. Application Data

(60) Provisional application No. 61/536,362, filed on Sep. 19, 2011, provisional application No. 61/569,152, (Continued)

(51) Int. Cl.
*H04R 3/02* (2006.01)
*G10K 11/16* (2006.01)
(Continued)

(52) U.S. Cl.
CPC ..... *G10K 11/16* (2013.01); *G10L 21/0208* (2013.01); *G10L 21/0216* (2013.01); (Continued)

(58) Field of Classification Search
CPC ..... G10L 21/0208; G10L 21/0216; G10L 2021/02166; G10L 21/0224; G10L 21/0232; H04R 1/1083; H04R 1/406; H04R 3/005; H04R 3/02; H04R 5/027; H04R 2201/107; H04R 2201/109; H04R 2201/403; H04R 2410/03; H04R 2410/07; H04R 2430/20; H04R 2499/13; H04R 2410/05; H04R 2430/23; H04R 25/407; (Continued)

(56) References Cited

U.S. PATENT DOCUMENTS 6,230,122 B1 * 5/2001 Wu ..... G10L 21/0208 704/204
6,339,758 B1 * 1/2002 Kanazawa et al. ..... 704/226
(Continued)

*Primary Examiner* — Mark Fischer
(74) *Attorney, Agent, or Firm* — Amin, Turocy & Watson, LLP

(57) ABSTRACT

Systems, methods, and apparatus for facilitating multi-sensor signal optimization for speech communication are presented herein. A sensor component including acoustic sensors can be configured to detect sound and generate, based on the sound, first sound information associated with a first sensor of the acoustic sensors and second sound information associated with a second sensor of the acoustic sensors. Further, an audio processing component can be configured to generate filtered sound information based on the first sound information, the second sound information, and a spatial filter associated with the acoustic sensors; determine noise levels for the first sound information, the second sound information, and the filtered sound information; and generate output sound information based on a selection of one of the noise levels or a weighted combination of the noise levels.

20 Claims, 23 Drawing Sheets

Related U.S. Application Data filed on Dec. 9, 2011, provisional application No. 61/651,601, filed on May 25, 2012.

(51) Int. Cl.
*G10L 21/0208* (2013.01)
*G10L 21/0216* (2013.01)
*G10L 21/0232* (2013.01)

(52) U.S. Cl.
CPC *G10L 21/0232* (2013.01); *G10L 2021/02166* (2013.01); *H04R 2201/107* (2013.01); *H04R 2410/05* (2013.01); *H04R 2410/07* (2013.01); *H04R 2430/23* (2013.01); *H04R 2499/13* (2013.01)

(58) Field of Classification Search
CPC ..... H04R 29/005; H04R 2201/401; H04R 2201/405; H04R 2430/21; H04R 2430/25; H04R 1/1016; G10K 11/1784; G10K 2210/1081; G10K 2210/1082; G10K 2210/3012; G10K 2210/3014; G10K 2210/3025; G10K 2210/3042; G10K 2210/3045; G10K 2210/3215; G10K 11/16; H04M 9/082
See application file for complete search history.

(56) References Cited

U.S. PATENT DOCUMENTS

| | | | | |
|---|---|---|---|---|
| 7,035,415 | B2 * | 4/2006 | Belt et al. | 381/92 |
| 7,778,425 | B2 * | 8/2010 | Kajala et al. | 381/92 |
| 8,565,459 | B2 * | 10/2013 | Rasmussen | 381/317 |
| 2005/0147258 | A1 * | 7/2005 | Myllyla et al. | 381/71.11 |
| 2006/0270468 | A1 * | 11/2006 | Hui et al. | 455/570 |
| 2007/0223717 | A1 * | 9/2007 | Boersma | H04M 1/6058 381/74 |
| 2011/0129097 | A1 * | 6/2011 | Andrea | 381/71.6 |
| 2012/0239385 | A1 * | 9/2012 | Hersbach et al. | 704/200.1 |
| 2013/0039503 | A1 * | 2/2013 | Beaucoup et al. | 381/66 |
| 2013/0308784 | A1 * | 11/2013 | Dickins | H04R 3/005 381/56 |

* cited by examiner

2100

MULTI-SENSOR SIGNAL OPTIMIZATION FOR SPEECH COMMUNICATION

PRIORITY CLAIM

This application claims priority to U.S. Provisional Patent Application Ser. No. 61/536,362, filed on Sep. 19, 2011, entitled "SYSTEM AND APPARATUS FOR WEAR-ARRAY HEADPHONE FOR COMMUNICATION, ENTERTAINMENT AND HEARING PROTECTION WITH ACOUSTIC ECHO CONTROL AND NOISE CANCELLATION"; U.S. Provisional Patent Application Ser. No. 61/569,152, filed on Dec. 9, 2011, entitled "SYSTEM AND APPARATUS WITH EXTREME WIND NOISE AND ENVIRONMENTAL NOISE RESISTANCE WITH INTEGRATED MULTI-SENSORS DESIGNED FOR SPEECH COMMUNICATION"; and U.S. Provisional Patent Application Ser. No. 61/651,601, filed on May 25, 2012, entitled "MULTI-SENSOR ARRAY WITH EXTREME WIND NOISE AND ENVIRONMENTAL NOISE SUPPRESSION FOR SPEECH COMMUNICATION", the respective entireties of which are each incorporated by reference herein.

TECHNICAL FIELD

This disclosure relates generally to speech communication including, but not limited to, multi-sensor signal optimization for speech communication.

BACKGROUND

Headphone systems including headsets equipped with a microphone can be used for entertainment and communication. Often, such devices are designed for people "on the move" who desire uninterrupted voice communications in outdoor settings. In such settings, a user of a headset can perform "hands free" control of the headset utilizing voice commands associated with a speech recognition engine, e.g., while riding on a bicycle, motorcycle, boat, vehicle, etc.

Although conventional speech processing systems enhance signal-to-noise ratios of speech communication systems utilizing directional microphones, such microphones are extremely susceptible to environmental noise such as wind noise, which can degrade headphone system performance and render such devices unusable.

The above-described deficiencies of today's speech communication environments and related technologies are merely intended to provide an overview of some of the problems of conventional technology, and are not intended to be exhaustive, representative, or always applicable. Other problems with the state of the art, and corresponding benefits of some of the various non-limiting embodiments described herein, may become further apparent upon review of the following detailed description.

SUMMARY

A simplified summary is provided herein to help enable a basic or general understanding of various aspects of illustrative, non-limiting embodiments that follow in the more detailed description and the accompanying drawings. This summary is not intended, however, as an extensive or exhaustive overview. Instead, the sole purpose of this summary is to present some concepts related to some illustrative non-limiting embodiments in a simplified form as a prelude to the more detailed description of the various embodiments that follow. It will also be appreciated that the detailed description may include additional or alternative embodiments beyond those described in this summary.

In accordance with one or more embodiments, computing noise information for microphones and an output of a spatial filter, and selecting a portion of the noise information, or an optimized combination of portions of the noise information, are provided in order to enhance the performance of speech communication devices, e.g., used in noisy environments.

In one embodiment, a system, e.g., including a headset, a helmet, etc. can include a sensor component including acoustic sensors, e.g., microphones, a bone conduction microphone, an air conduction microphone, an omnidirectional sensor, etc. that can detect sound and generate, based on the sound, first sound information associated with a first sensor of the acoustic sensors and second sound information associated with a second sensor of the acoustic sensors. Further, an audio processing component, e.g., a digital signal processor, etc. can generate filtered sound information based on the first sound information, the second sound information, and a spatial filter. For instance, the spatial filter, e.g., a beamformer, an adaptive beamformer, etc. can be associated with a beam corresponding to a predetermined angle associated with positions of the acoustic sensors. Furthermore, the audio processing component can determine noise levels, e.g., signal-to-noise ratios, etc. for the first sound information, the second sound information, and the filtered sound information; and generate output sound information based on a selection of one of the noise levels, or a weighted combination of the noise levels.

In another embodiment, a transceiver component can send the output sound information directed to a communication device, e.g., a mobile phone, a cellular device, etc. via a wired data connection or a wireless data connection, e.g., a 802.X -based wireless connection, a Bluetooth® based wireless connection, etc. In yet another embodiment, the transceiver component can receive audio data from the communication device via the wireless data connection or the wired data connection. Further, the system can include speakers, e.g., included in an earplug, that can generate sound waves based on the audio data.

In one or more example embodiments, the first sensor can be a first microphone positioned at a first location corresponding to a first speaker of the speakers. Further, the second sensor can be a second microphone positioned at a second location corresponding to a second speaker of the speakers. As such, each sensor can be embedded in a speaker housing, e.g., an earbud, etc. that is proximate to an eardrum of a user of an associated communications device. In another example, a bone conduction microphone can be positioned adjacent to an air conduction microphone within a structure, e.g., soft rubber material enclosed with air. Further, a foam material can be positioned between the structure and the bone and air conduction microphones, e.g., to reduce mechanical vibration, etc. Furthermore, a membrane, e.g., thin membrane, can be positioned adjacent to the microphones, e.g., to facilitate filtering of wind, contact to a user's skin, etc. Further, the structure can include an air tube that can facilitate inflation and/or deflation of the structure.

In one example, each speaker can generate sound waves 180° out of phase from each other, e.g., to facilitate cancellation, e.g., via one or more beamforming techniques, of an echo induced by close proximity of a microphone to a speaker. In another example, a first tube can mechanically couple a first earplug to a first speaker, and a second tube can mechanically couple a second earplug to a second speaker. As such, the tubes can facilitate delivery of environmental sounds to a user's ear, e.g., for safety reasons, etc. while the user listens to sound output from the speakers.

In one non-limiting implementation, a method can include receiving, via sound sensors of a computing device, sound information; determining, based on the sound information, signal-to-noise ratios (SNRs) associated with the sound sensors; determining, based on the sound information and spatial information associated with the sound sensors, beamforming information; determining a signal-to-noise ratio of the SNRs based on the beamforming information; and creating output data in response to selecting, based on a predetermined noise condition, one of the SNRs or a weighted combination of the SNRs.

Further, the method can include determining environmental noise associated with the sound information, and filtering a portion of the sound information based on the environmental noise. In one embodiment, the method can include determining echo information associated with acoustic coupling between the sound sensors and speakers of the computing device; and filtering a portion of the sound information based on the echo information.

In another non-limiting implementation, a computer readable medium comprising computer executable instructions that, in response to execution, cause a system including a processor to perform operations, comprising receiving sound data via microphones; determining, based on the sound data, a first level of noise associated with a first microphone of the microphones; determining, based on the sound data, a second level of noise associated with a second microphone of the microphones; determining, based on the sound data and a predefined angle of beam propagation associated with positions of the microphones, a third level of noise; and generating, based on the first, second, and third levels of noise, output data in response to noise information being determined to satisfy a predefined condition with respect to a predetermined level of noise.

In one embodiment, the first microphone is a bone conduction microphone and the second microphone is an air conduction microphone. In another embodiment, the microphones are air conduction microphones.

Other embodiments and various non-limiting examples, scenarios, and implementations are described in more detail below.

BRIEF DESCRIPTION OF THE DRAWINGS

Various non-limiting embodiments are further described with reference to the accompanying drawings in which.

DETAILED DESCRIPTION

Figure 1:
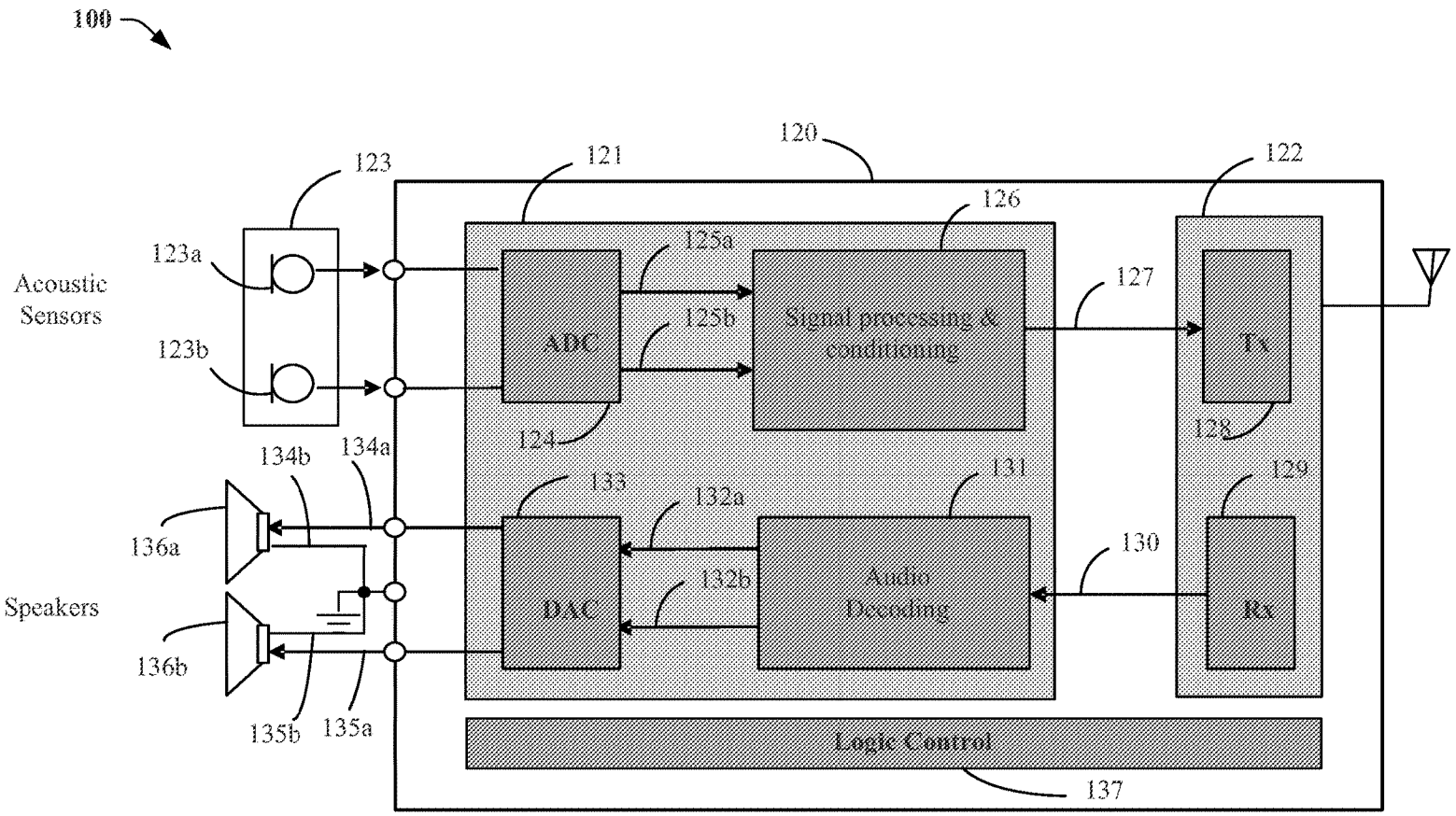
FIG. 1 illustrates a block diagram of a multi-sensor device, in accordance with various embodiments.

Various non-limiting embodiments of systems, methods, and apparatus presented herein enhance the performance of speech communication devices, e.g., used in noisy environments. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

As utilized herein, terms "component", "system", and the like are intended to refer to hardware, a computer-related entity, software (e.g., in execution), and/or firmware. For example, a component can be an electronic circuit, a device, e.g., a sensor, a speaker, etc. communicatively coupled to the electronic circuit, a digital signal processing device, an audio processing device, a processor, a process running on a processor, an object, an executable, a program, a storage device, and/or a computer. By way of illustration, an application, firmware, etc. running on a computing device and the computing device can be a component. One or more components can reside within a process, and a component can be localized on one computing device and/or distributed between two or more computing devices.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus, a structure, etc. with specific functionality provided by mechanical part(s) that house and/or are operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

The word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

Artificial intelligence based systems, e.g., utilizing explicitly and/or implicitly trained classifiers, can be employed in connection with performing inference and/or probabilistic determinations and/or statistical-based determinations as in accordance with one or more aspects of the disclosed subject matter as described herein. For example, an artificial intelligence system can be used, via an audio processing component (see below), to generate filtered sound information derived from sensor inputs and a spatial filter, e.g., an adaptive beamformer, and select an optimal noise level associated with the filtered sound information, e.g., for speech communications.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification schemes and/or systems (e.g., support vector machines, neural networks, expert systems, Bayesian belief networks, fuzzy logic, and data fusion engines) can be employed in connection with performing automatic and/or inferred action in connection with the disclosed subject matter.

In addition, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, computer-readable carrier, or computer-readable media. For example, computer-readable media can include, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

As described above, conventional speech processing techniques are susceptible to environmental noise such as wind noise, which can degrade headphone system performance and render such devices unusable. Compared to such technology, various systems, methods, and apparatus described herein in various embodiments can improve user experience(s) by enhancing the performance of speech communication devices, e.g., used in noisy environments.

Referring now to FIG. 1, a block diagram of a multi-sensor device 100 is illustrated, in accordance with various embodiments. Aspects of multi-sensor device 100, systems, networks, other apparatus, and processes explained herein can constitute machine-executable instructions embodied within machine(s), e.g., embodied in one or more computer readable mediums (or media) associated with one or more machines. Such instructions, when executed by the one or more machines, e.g., computer(s), computing device(s), etc. can cause the machine(s) to perform the operations described.

Additionally, the systems and processes explained herein can be embodied within hardware, such as an application specific integrated circuit (ASIC) or the like. Further, the order in which some or all of the process blocks appear in each process should not be deemed limiting. Rather, it should be understood by a person of ordinary skill in the art having the benefit of the instant disclosure that some of the process blocks can be executed in a variety of orders not illustrated.

As illustrated by FIG. 1, multi-sensor device 100 includes electrical circuitry 120 with wired and/or wireless capability. In one or more embodiments, electrical circuitry 120 can be divided into 3 major functional blocks including audio processing component 121, transceiver component 122, and logic control component 137. Audio processing component 121 performs input/output audio processing, e.g., beamforming, digital filtering, echo cancellation, etc. and transceiver component 122, e.g., a Bluetooth® transceiver, an 802.X based transceiver, etc. provides wireless capability for data exchange with a communications device, e.g., a mobile phone, a cellular device, a base station, etc. Further, logic control component 137 manages the flow control and interaction between different components of multi-sensor device 100.

Sensor component 123 can detect sound via acoustic sensors 123*a* and 123*b*, and generate, based on the sound, first sound information associated with acoustic sensor 123*a* and second sound information associated with acoustic sensor 123*b*. Audio processing component 121 can receive the first and second sound information via analog-to-digital converter (ADC) 124 that converts such information to digital form. Further, signal processing and conditioning component 126, e.g., a digital signal processor, etc. can generate filtered sound information based on the first sound information, the second sound information, and a spatial filter associated with the acoustic sensors. In one embodiment, the spatial filter can use spatial information associated with the signals to differentiate speech and unwanted signals, e.g., associated with noise.

As such, in one aspect, audio processing component 121 can use the spatial information to enforce speech signal(s) picked up from a mouth of a user of multi-sensor device 100, and to suppress or separate interference signal(s) from the speech signal(s). In one or more embodiments, the spatial filter, e.g., a beamformer, an adaptive beamformer, etc. can be associated with a beam corresponding to a predetermined angle associated with positions of acoustic sensors 123. Furthermore, signal processing and conditioning component 126 can determine noise levels, e.g., signal-to-noise ratios, etc. for the first sound information, the second sound information, and the filtered sound information; and generate output sound information based on a selection of one of the noise levels, or a weighted combination of the noise levels.

Figure 2:
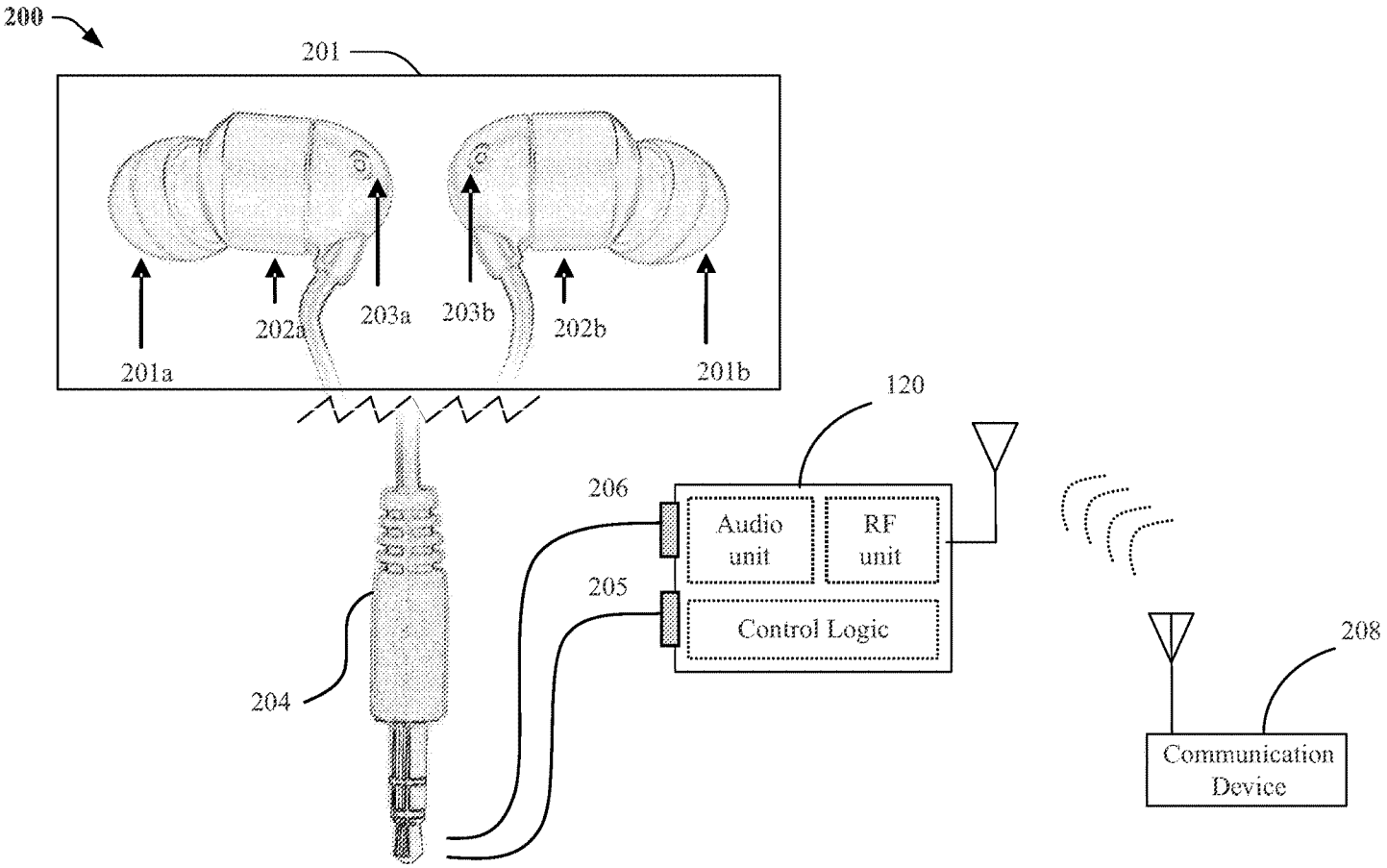
FIG. 2 illustrates a block diagram of a wired and/or wireless headphone system, in accordance with various embodiments.

In another embodiment, transceiver component 122 can send the output sound information directed to a communication device, e.g., a mobile phone, a cellular device, communications device 208 illustrated by FIG. 2, etc. via a wired data connection or a wireless data connection, e.g., a 802.X-based wireless connection, a Bluetooth® based wireless connection, etc.

Now referring to FIG. 2, a block diagram of a wired and/or wireless headphone system 200 is illustrated, in accordance with various embodiments. Headphone system 200 includes a headphone unit 201 with left/right speakers 202*a* and 202*b*, earplugs 201*a* and 201*b*, acoustic sensors 203*a* and 203*b*, electrical circuitry 120, and communication device 208. Communication device 208 can be a mobile phone device, a speech enabled device, an MP3 player, a base station, etc. In one embodiment, audio data such as music or voice information is transmitted between communication device 208 and electrical circuitry 120 via transceiver component 122. For example, such data can include mono/stereo audio streaming and/or speech signals. Further, such audio data can be in raw or processed form, e.g., compressed, encrypted, etc.

As illustrated by FIG. 1, audio data received by transceiver component 122 via a wired or wireless connection can be pre-processed by audio processing component 121 in certain formats, e.g., associated with compressed data, encrypted data, etc. Such data can be received by audio decoding component 131, which can perform inverse function(s) of such pre-processed data. Further, digital-to-analog converter (DAC) 133 can receive output data from audio decoding component 131, and convert the output data to analog signals that can be received by speakers 136*a* and 136*b*, e.g., speakers 202*a* and 202*b* through spk-out 206 via connector 204. Thus, speakers 202*a* and 202*b* can produce sound based on the analog signals.

On the other hand, acoustic sensors 203*a* and 203*b* can detect speech signal(s) from a user and communicate such signal(s) to electrical circuitry 120 through mic-in 205 via connector 204. Further, electrical circuitry 120 can process the speech signal(s) and send the processed signal(s) as output sound information to communication device 208.

Figure 3:
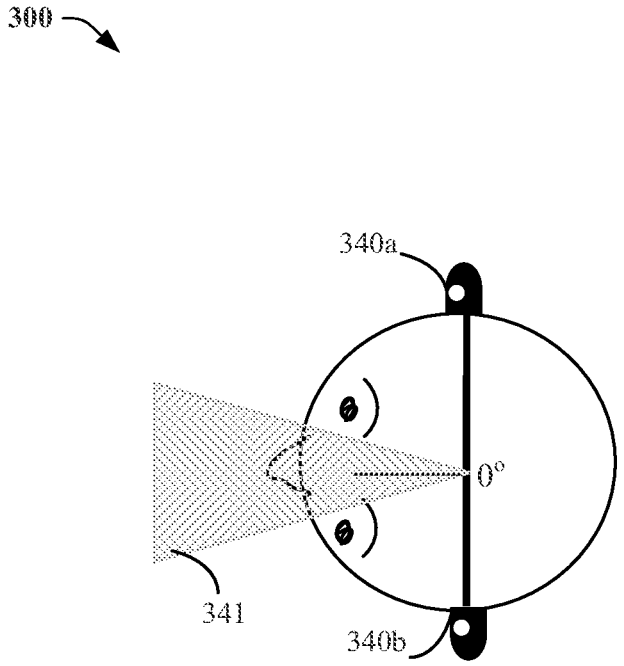
FIG. 3 illustrates a zone created in a center of an array associated with a digital beamformer, in accordance with an embodiment.

Acoustic sensors 203*a* and 203*b* can be mounted on a suitable position on each side of a headphone, e.g., in respective housings of left/right speakers 202*a* and 202*b*. As illustrated by FIG. 3, such a layout can create an aperture close to the typical width of the human head when the headphone is worn by the user. As such, in various embodiments, having two acoustic sensors very close to a user's eardrums enables optimal binaural hearing through the sensors. Further, in at least one embodiment, spatial information 341 between acoustic sensors 340*a* and 340*b* is optimum for digital signal processing using beamforming method(s) associated with a digital beamformer, e.g., digital beamformer 400, included in audio processing component 121.

Figure 4:
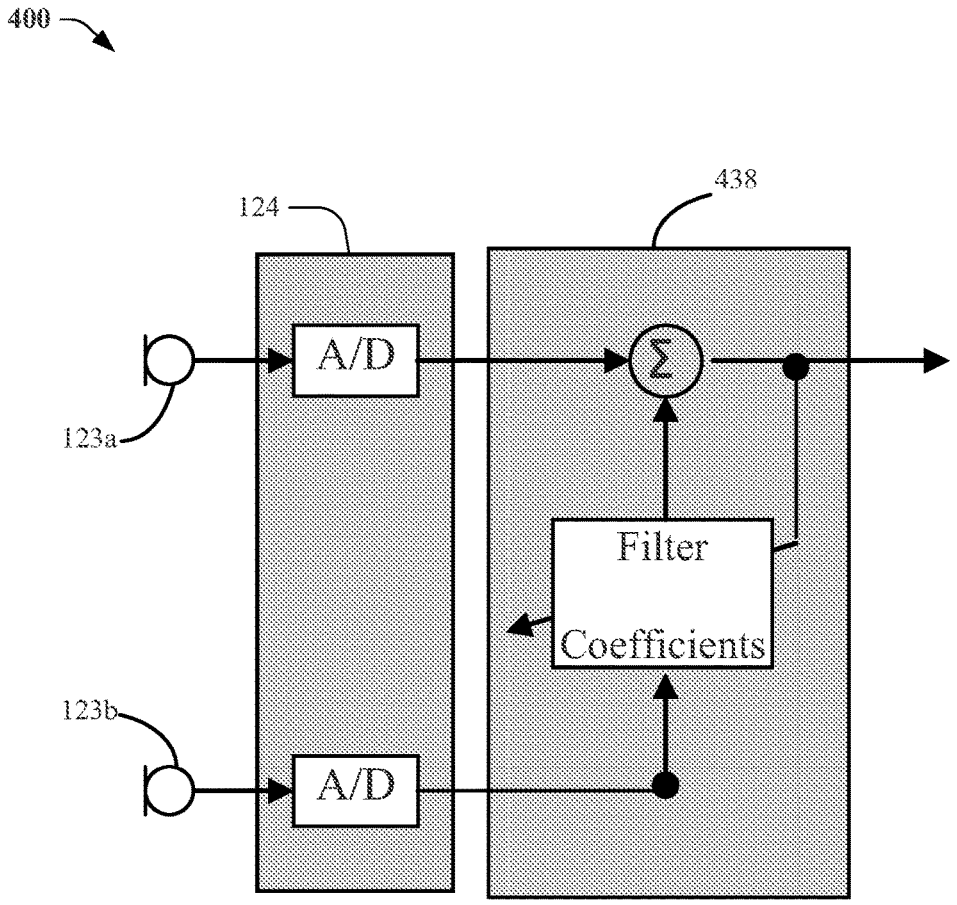
FIG. 4 illustrates a block diagram of a digital beamformer, in accordance with an embodiment.

As illustrated by FIG. 4, digital beamformer 400 receives input via ADC 124. Further, noise suppressor 438 can receive the input and form a "sweet zone", e.g., beam 341, from a center of an array formed by acoustic sensors 340*a* and 340*b*, e.g., from about 0 degrees from a line formed between acoustic sensors 340*a* and 340*b*. As such, digital beamformer 400 can enhance the amplitude of a coherent wavefront relative to background noise and directional interference, e.g., by computing a sum of multiple elements to achieve a narrower response in a desired direction.

As illustrated by FIG. 3, beam 341 can be formed from the center of the array to cover a mouth position of the user. The width of beam 341 can be defined as $\pm\theta$ degrees from the center of beam 341. In one embodiment, $\theta$ can be set as 7.5 degrees, e.g., as a narrower beam, which can produce better interference signal suppression. Another advantage of having acoustic sensors 340*a* and 340*b* mounted to the left/right position of a headphone is that such a layout is 'locked' to the movement of a person's head when the person wears the acoustic sensors in each ear. For example, while the person move his/her head, acoustic sensors 203*a* and 203*b* move in the same orientation with equal magnitude thus providing a consistent and stable reference with respect to a position of the person's mouth. In such a layout, the position of the person's mouth appears from the center of the array formed by acoustic sensors 203*a* and 203*b*. This translates to about 0 degrees using beamformer 400. Thus, it is possible to form sweet zone 341 centered around 0 degrees using beamformer 400 that covers the mouth position without having to know the exact dimension of the array formed by acoustic sensors 203*a* and 203*b*.

In one embodiment, acoustic sensors 203*a* and 203*b* can be of an omnidirectional type of sensor, e.g., less subject to acoustic constraints. Further, in order to accommodate for different use cases, additional signal processing methods or beamforming methods with different parameters can be performed by audio processing component 121. For example, audio processing component 121 can produce an output 127 that includes an optimized weighted output, e.g., to facilitate optimal operation of headphone system 200 when one of the acoustic sensors failed and/or is not in use. In another embodiment, headphone system 200 can process signals, e.g., associated with wind noise cancellation and/or environmental noise cancellation, in a hearing assist mode of operation of a hearing aid device.

Figure 5:
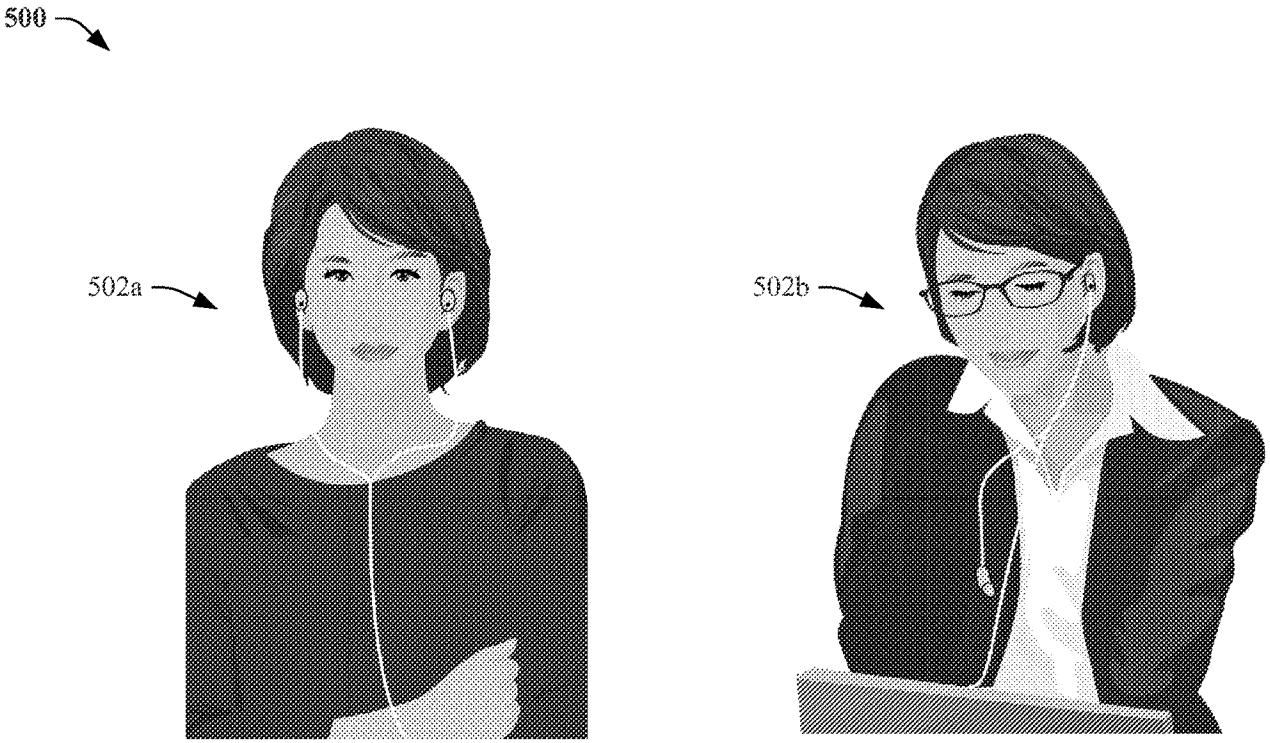
FIG. 5 illustrates positioning of a headphone device, in accordance with various embodiments.

For example, FIG. 5 illustrates a use 502*a* of both acoustic sensors. However in many situations, such as riding a bike, a user may use only one side of headphone system 200 as illustrated by use 502*b*. As such, any one of the two acoustic sensors can provide, in some embodiments, a better signal quality than an output produced by beamformer 400. In other embodiments, beamformer 400 can adapt to new positions of acoustic sensors 203*a* and 203*b* to provide optimal performance.

Figure 6:
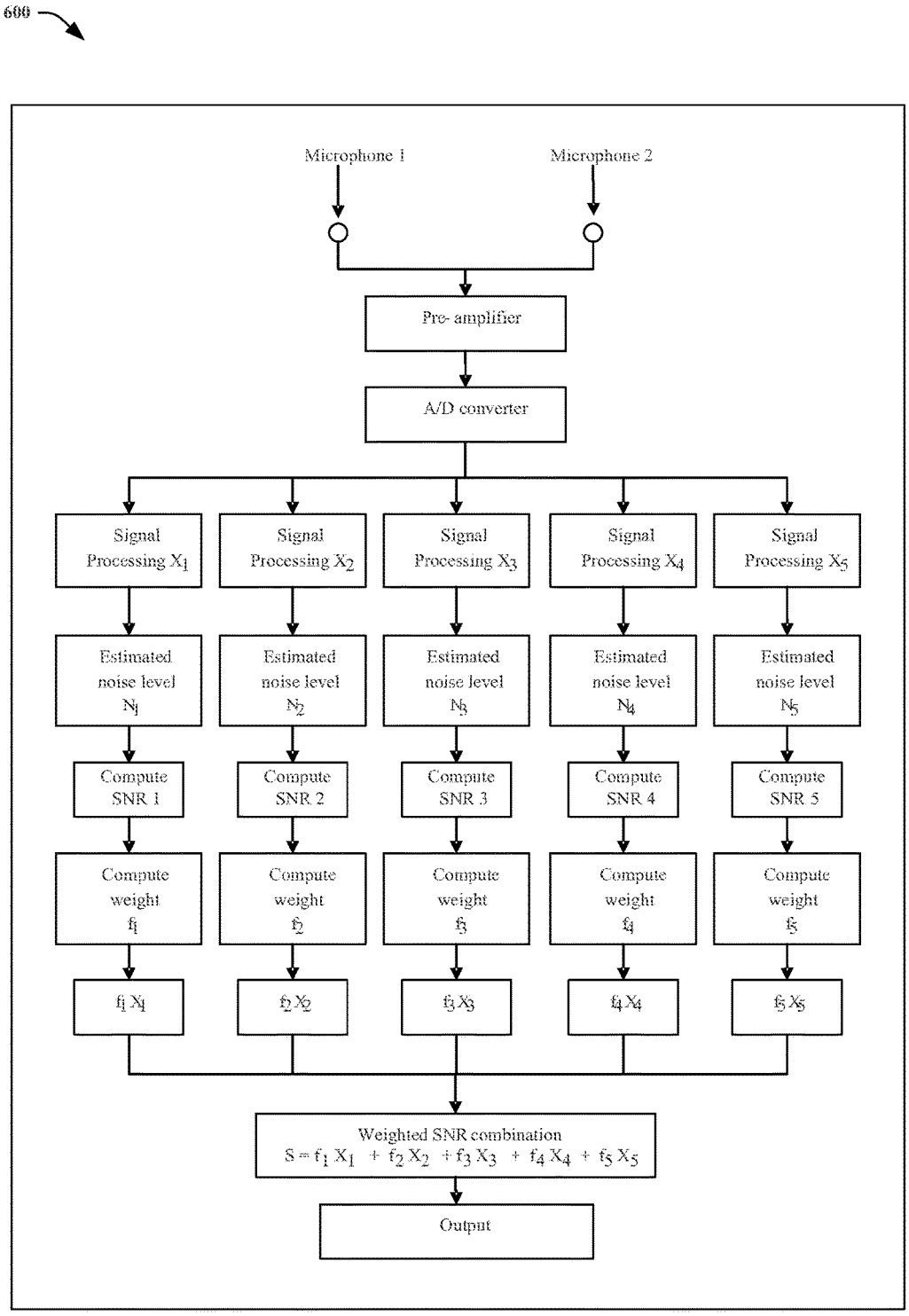
FIG. 6 illustrates process steps associated with a dual acoustic sensor device, in accordance with various embodiments.

As illustrated by FIG. 6, several different beamforming techniques utilizing one or more processing steps of 600 can be utilized by audio processing component 121 to process signals from acoustic sensors 123*a* and 123*b*. FIG. 6 illustrates five different processes. A noise level from each process output is estimated and the signal-to-noise ratio (SNR) is also estimated. Using the SNR from each processed output, a weighting function can be adopted based on equation (1), so the output is the optimized combination of the output for all processes as follows:

$$S=f_1X_1+f_2X_2+f_3X_3+f_4X_4+f_5X_5 \quad (1)$$

Further, in one embodiment, audio processing component 121 can select a process that provides the highest SNR. For example, in this case, the weighting function will consist of a 1 in the process with the highest SNR and zero for all the other processes. In such a "winner take all", or maximum SNR set up, the weighting function $f_i$ is based on equation (2) as follows, which indicates that a process associated with the first vector index and the highest SNR is chosen:

$$f_i=[1,0,0,0,0] \quad (2)$$

In another embodiment, another weighting function is proportional to the SNR for each process. Further, other non-linear weighting functions can also be used, e.g., weighting processes with a high SNR more heavily than processes with lower SNRs.

In other embodiments, acoustic sensors 123*a* and 123*b* can "pick up" signals from speakers 136*a* and 136*b* due to acoustic coupling, e.g., due to acoustic sensors 123*a* and 123*b* being placed in close proximity with the speakers 136*a* and 136*b*. Such 'picked up' signals will appear as echo to a remote user, e.g., associated with output sound information transmitted by a multi-sensor device described herein, and/or be included as interference in such information.

However, if the left/right speakers 136*a* and 136*b* are made to produce sound waves in opposite phases, the signals induced in acoustic sensors 123*a* and 123*b* will be out of phase. This method generates artificial information to beamformer 400, e.g., that the sound source is not from within the sweet zone and can be separated out and suppressed. Such induced phase inversion produces sound waves that can be automatically suppressed through the beamforming, e.g., since human ears are not sensitive to sound waves in opposite phases.

Referring now to FIG. 1, electrical connections 134*a*, 134*b*, 135*a*, and 135*b* enable the generation of sound waves in opposite phases on left/right speakers 136*a* and 136*b*. As illustrated, by FIG. 1, the electrical connection to one of the speakers is reversed (the electrical connections of 135*a* and 135*b* are in reverse direction of electrical connections of 134*a* and 134*b*, in this case the sound waves generated by speakers 136*a* are 180° out of phase from other sound waves generated by speakers 136*b*. In another embodiment, phase inversion can be achieved through software adjustment. For example, the signal at input 132*b* of DAC 133 can be multiplied by −1 in digital form, which will produce an analog signal 180° out of phase from a signal at input 132*a*.

Figure 7:
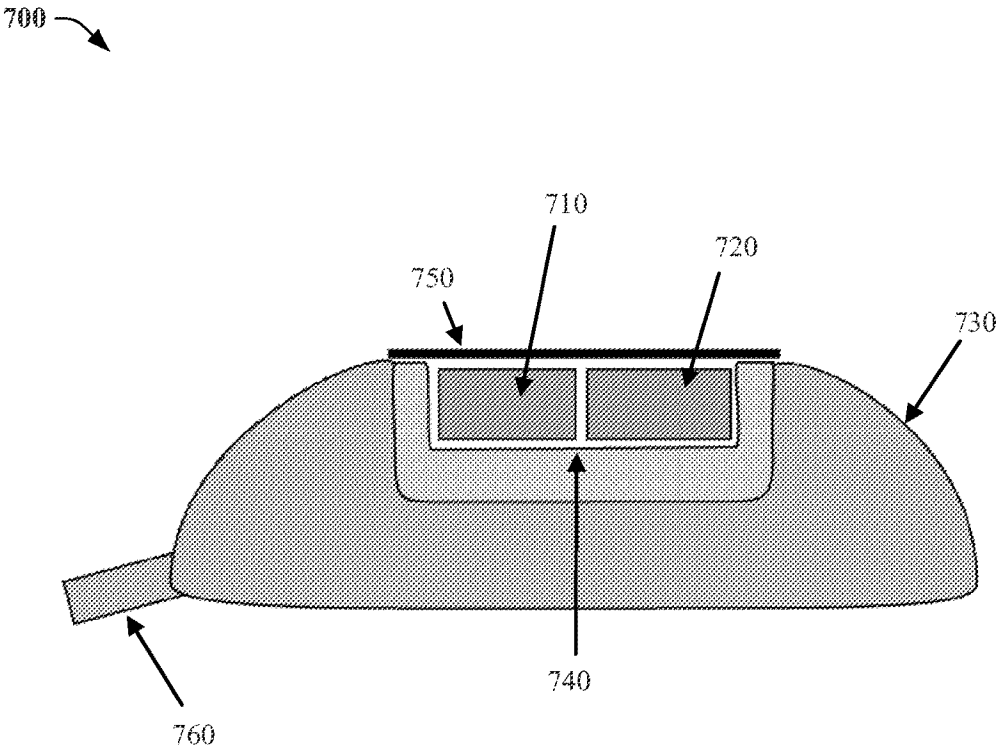
FIG. 7 illustrates a structure for housing an air-conduction microphone and a bone conduction microphone, in accordance with an embodiment.
Figure 8:
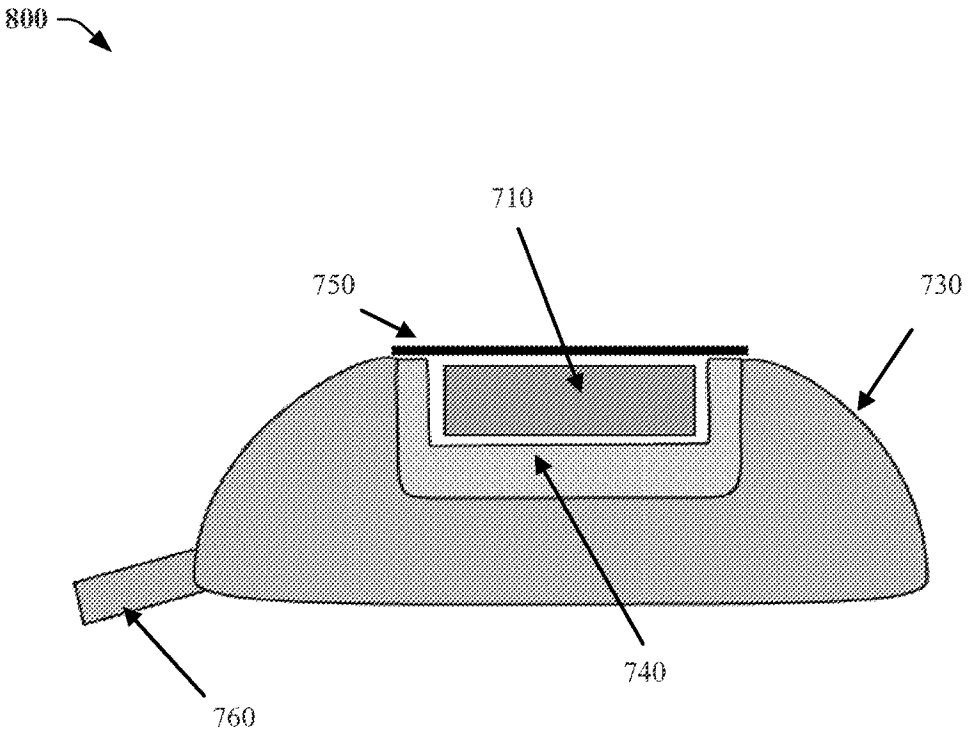
FIG. 8 illustrates another structure for housing a bone conduction microphone, in accordance with an embodiment.

Now referring to FIGS. 7-11, various embodiments associated with housing an air-conduction microphone and a bone conduction microphone in a structure 730 associated with a headset, helmet, etc. are illustrated. As illustrated by FIG. 7, two different acoustic sensors, a bone conduction microphone 710 and an air-conduction microphone 720 are integrated into structure 730, e.g., a soft rubber material. For ease of use, the acoustic sensors are placed next to each other and into the same pocket. This approach makes the system easy to install into any helmet, and makes the system easy to use by new users.

Structure 730 can be inflated by blowing air into its housing using air tube 760, e.g., a one-way air tube, which enables a user to inflate structure 730 so that the acoustic sensors can achieve good contact with a user's skin surface, but not cause any discomfort to the user during prolonged use. For example, structure 730 can be inflated by blowing air into structure 730 using a mouthpiece (not shown) or a small balloon (not shown) attached to tube 760, which can be removed easily after the user has inflated structure 730 to achieve good contact and comfort.

In an embodiment, an inner housing of structure 730 can be filled with soft foam 740 to help maintain the shape of structure 730. Further, the acoustic sensors can be separated by a soft cushion (not shown) to further reduce any mechanical vibration that may transmit as signals from the helmet to the sensors. In yet another embodiment, soft membrane 750 can act as wind filter for air conduction microphone 720, while providing a soft contact to the user's skin surface.

Structure 730 can be attached to a helmet/form part of the helmet, freeing the user from any entangling wire(s), etc. Further, structure 730 can be built in different dimensions, e.g., to facilitate fitting structure 730 into helmets of different sizes. Furthermore, in an embodiment illustrated by FIG. 8, structure 730 can be embedded with one bone conduction microphone.

Figure 9:
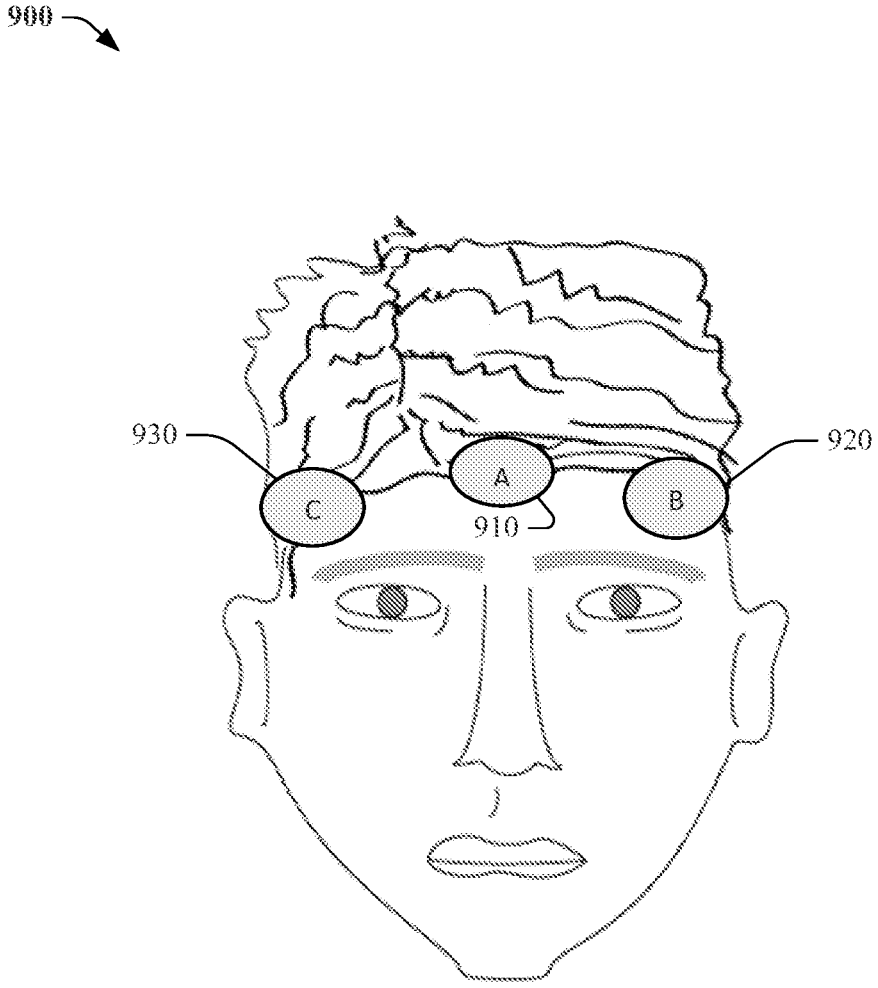
FIG. 9 illustrates locations for placing a structure including dual acoustic sensors in a head area, in accordance with various embodiments.

FIG. 9 illustrates locations 910-930 for placing structure 730 in a head area, in accordance with various embodiments. As illustrated by FIG. 9, structure 730, when housed in a helmet, can be mounted on a position of the helmet that corresponds to the left/right side of the temple or anywhere on the forehead between the temples, e.g., at locations 910-930. However, structure 730 can be located at positions within an entire cavity inside of a helmet.

Figure 10:
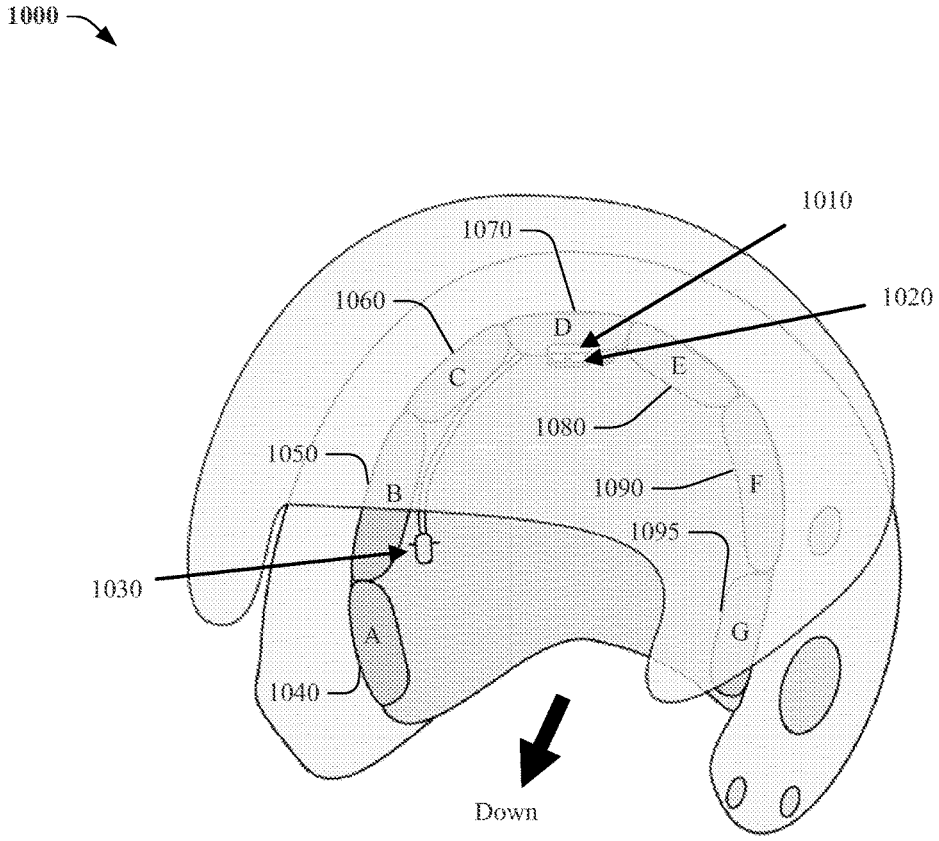
FIG. 10 illustrates locations for mounting a structure including dual acoustic sensors on a helmet, in accordance with various embodiments.

FIG. 10 illustrates locations for mounting structure 1010 including acoustic sensors 1020 on an inner lining of a helmet, in accordance with various embodiments. As illustrated by FIG. 10, structure 1010, e.g., a soft rubber bubble, can house acoustic sensors 1020 at positions 1040-1095, e.g., utilizing Velcro® or other adhesive-type material. As such, the structure 1010 can form a part of the helmet, with nothing attaching to a user's head or body. Thus, a user is free from entangling wires, etc. Further, the user can inflate structure 1010 by blowing air into air tube 1030 after wearing helmet 1000 so as to achieve good contact.

Figure 11:
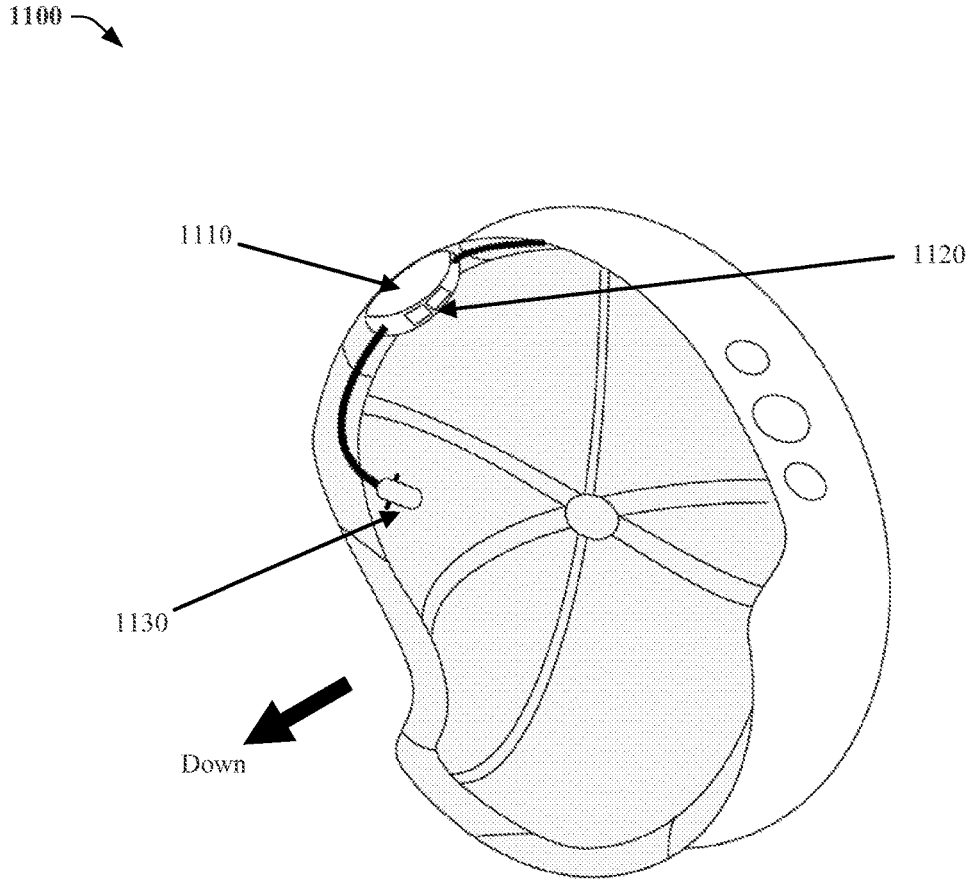
FIG. 11 illustrates another dual structure including dual acoustic sensors mounted on a helmet.

FIG. 11 illustrates another structure 1110 including acoustic sensors 1120 mounted on a forehead headband stripe of helmet 1100, in accordance with an embodiment. As such, in reference to FIG. 9, acoustic sensors 1120 can be mounted at positions of the forehead headband stripe corresponding to location 910, 920, 930, and/or other locations not illustrated by FIG. 9. Such locations can be selected based on achieving good contact with a user's forehead and can be associated with good signal pickup associated with, e.g., both air and bone conduction microphones included in acoustic sensors 1120. Further, air tube 1130 can be used to inflate portion(s) of structure 1110 to achieve optimal contact with a user's skin.

Figure 12:
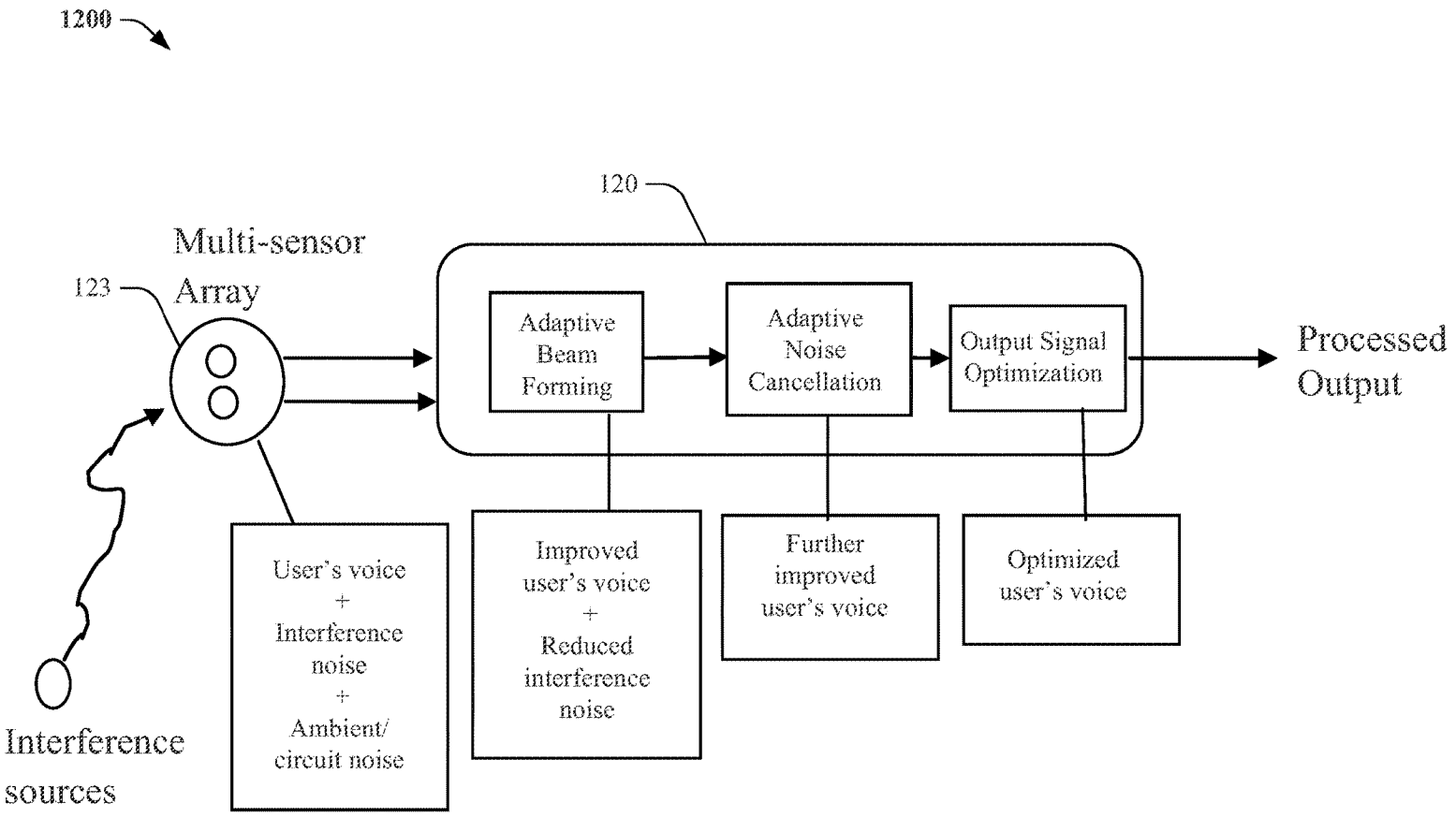
FIG. 12 illustrates a block diagram of a multi-sensor system, in accordance with various embodiments.
Figure 13:
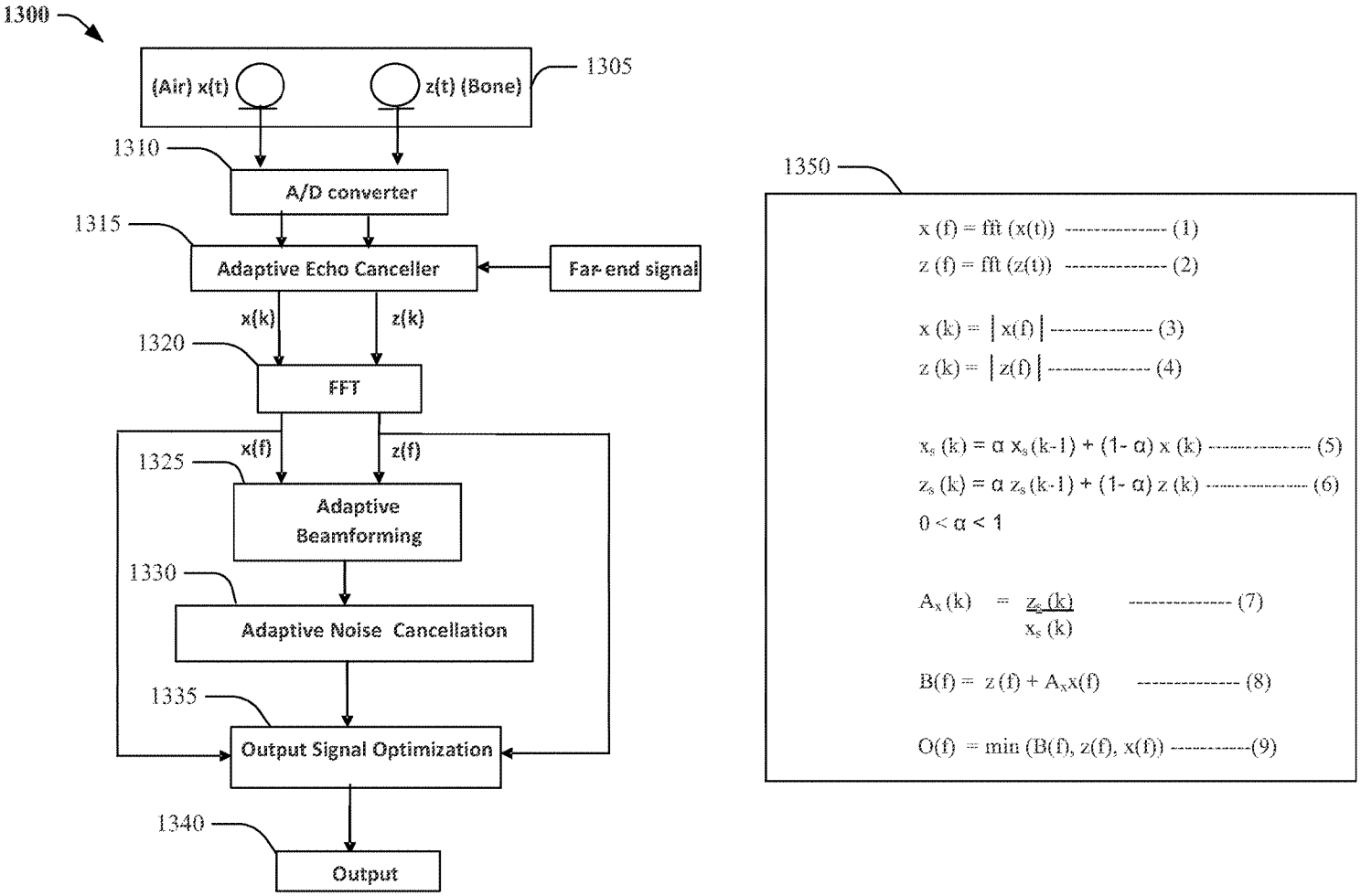
FIG. 13 illustrates various components and associated processing steps associated with a dual acoustic sensor device, in accordance with various embodiments.

FIGS. 12 and 13 illustrate a block diagram of a multi-sensor system 1200, and various components and associated processing steps associated multi-sensor system 1200, respectively, in accordance with various embodiments. At 1305, a multi-sensor array, e.g., 123, can detect sound including a user's voice, interference noise, and ambient/circuit noise and generate sound information based on the sound. At 1310, ADC 124 can convert the sound information into digital data. At 1315 through 1330, various components including an adaptive echo canceler component, a fast Fourier transform (FFT) component, an adaptive beamforming component, and an adaptive noise cancellation component can perform various processing according to algorithms 1350. At 1335, an output signal optimization component can apply minimization algorithm (9) of algorithms 1350 based on an output of the adaptive beamforming component, the bone conduction microphone, and an air conduction microphone to obtain an output with optimized noise level and speech quality.

Figure 14:
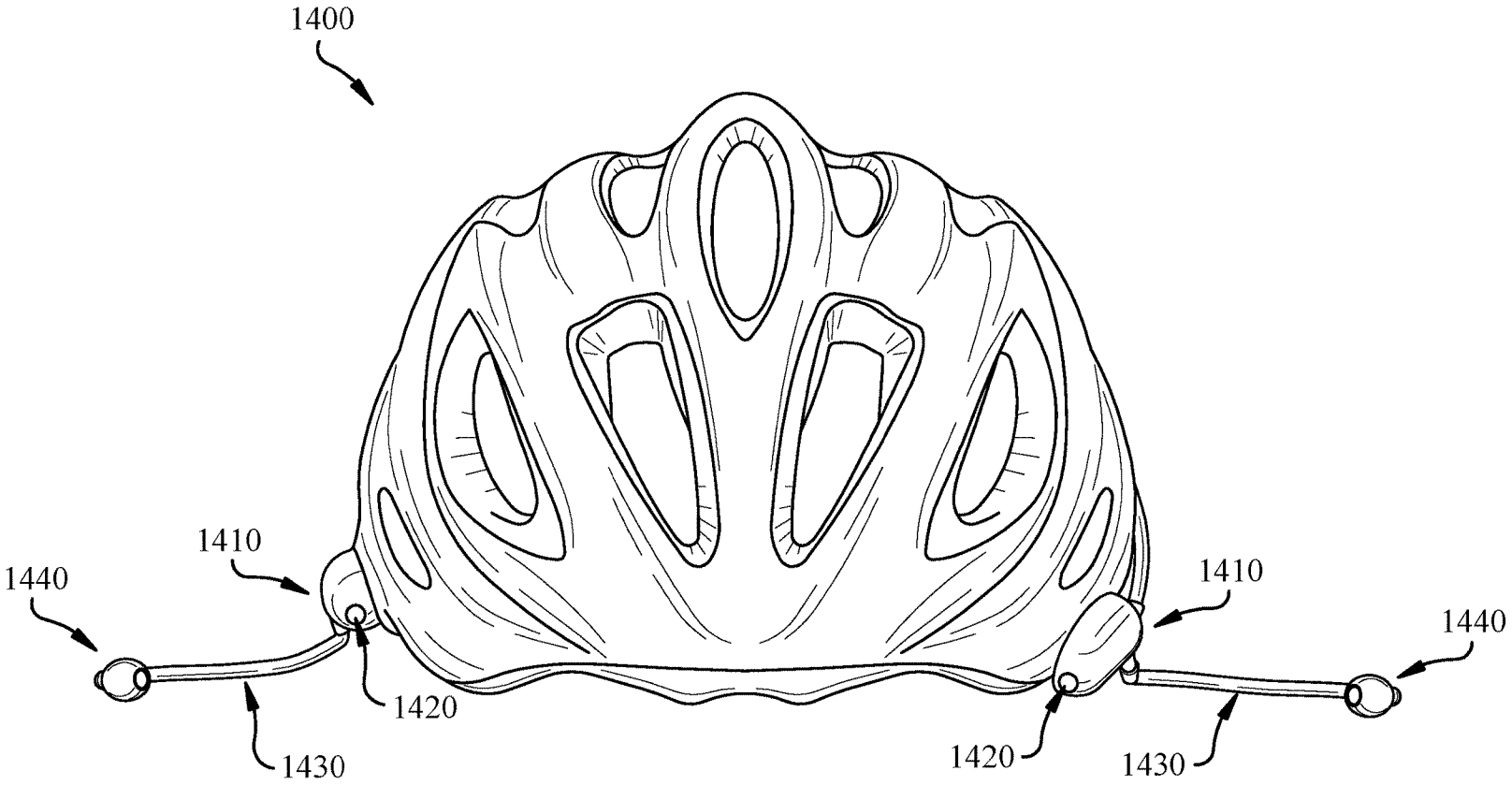
FIG. 14 illustrates a bicycle helmet including a dual acoustic sensor device, in accordance with an embodiment.

Now referring to FIG. 14, a bicycle helmet 1400 including acoustic sensors 1420 is illustrated, in accordance with an embodiment. Acoustic sensors 1420, e.g., omnidirectional microphones, are fully integrated into housings mounted on each side of bicycle helmet 1400, together with two small speakers 1410. Further, voice tubes 1430 connecting earplugs 1440 to speakers 1410 can deliver environmental sounds to a user's ears, e.g., enabling a user to continuously hear such sounds for safety reasons as the user listens to the output from speakers 1440.

Figure 15:
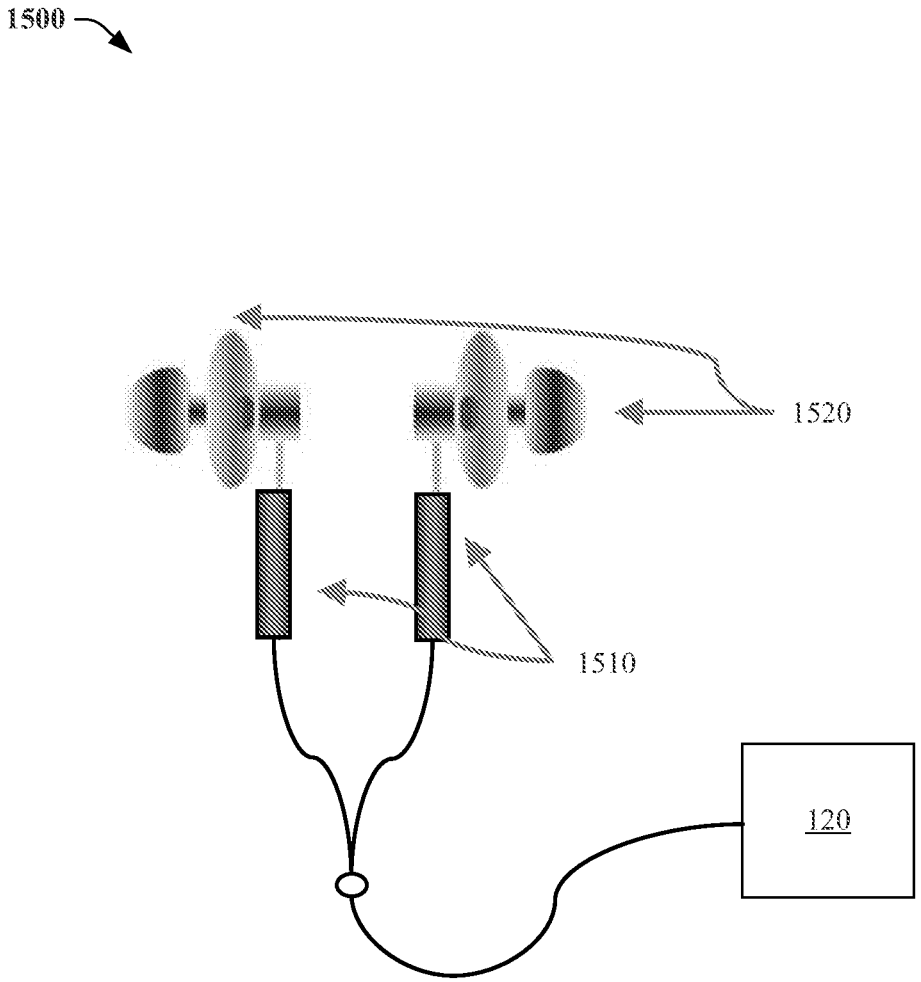
FIG. 15 illustrates a headset including dual acoustic sensors, in accordance with an embodiment.

FIG. 15 illustrates a headset system 1500 including acoustic sensors 1510, in accordance with an embodiment. As illustrated by FIG. 15, headset system 1500 includes earplugs 1520 and microphones 1510 embedded in a wire electronically coupling acoustic sensors 1510 to electrical circuitry 120. A user can use such a headset while riding a bike, walking, etc. and for safety reasons, use only one side of the headset, e.g., to sense environmental sounds.

Figure 16:
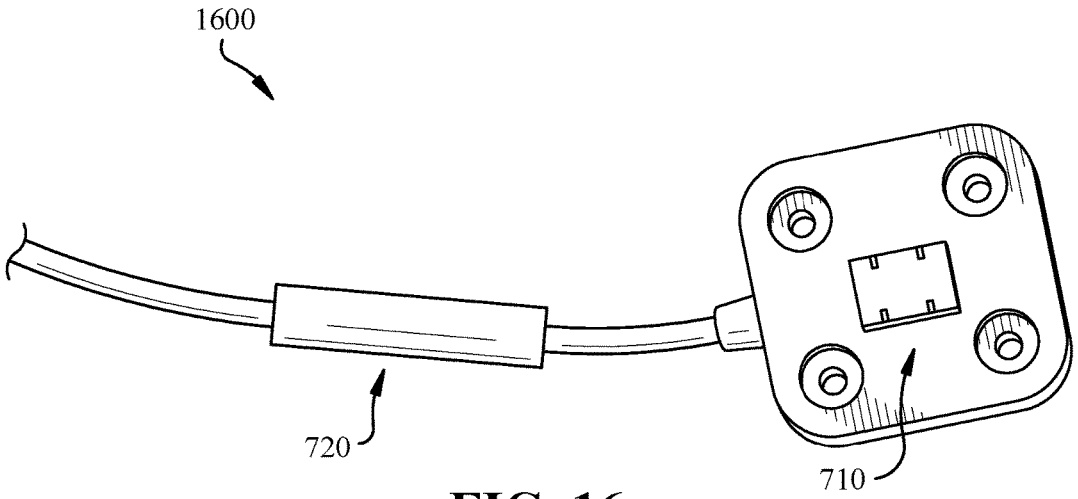
FIG. 16 illustrates an air conduction microphone and a bone conduction microphone, in accordance with an embodiment.

FIG. 16 illustrates a structure 1600 including air conduction microphone 720 and bone conduction microphone 710. As described above, such a structure can be attached to a helmet, freeing a user from being entangled in wires, etc. Further, structure 1600 can be mounted at any location of the helmet, e.g., inner headband, inner lining, etc. to achieve optimal skin contact and signal pickup.

Figure 17:
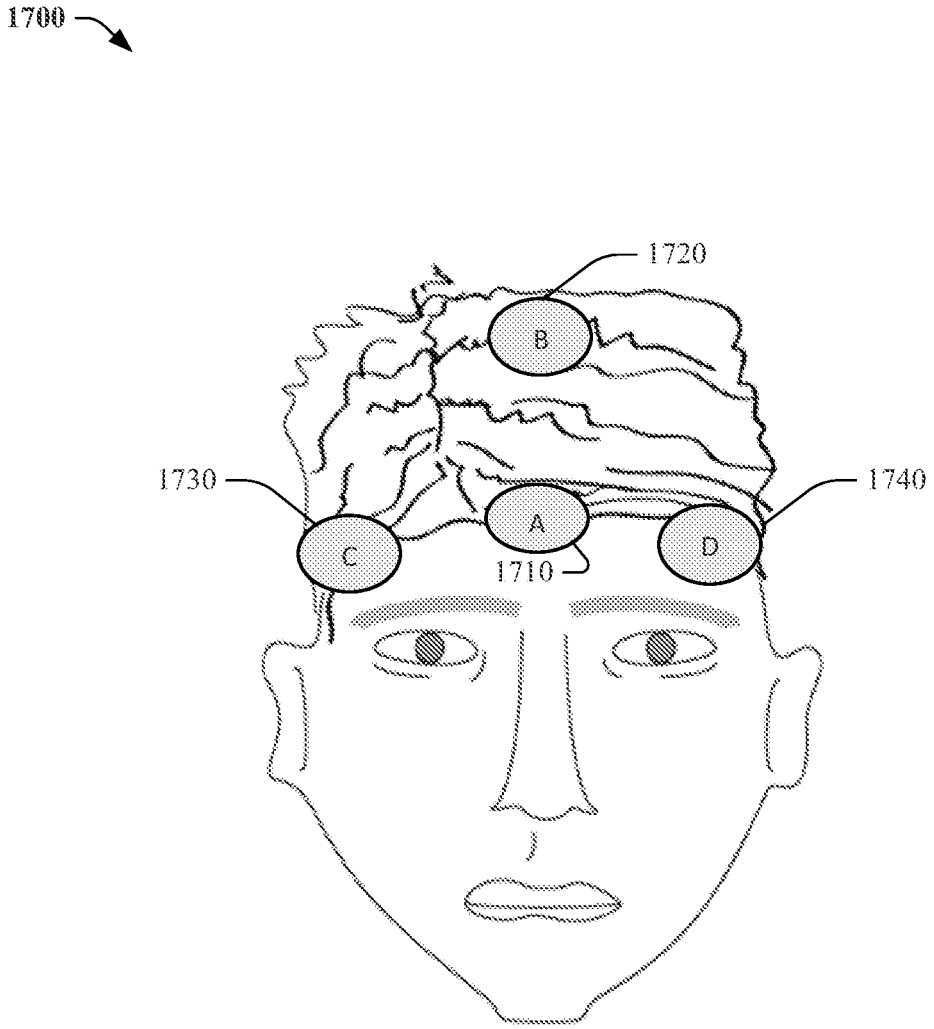
FIG. 17 illustrates various locations for placing a structure including dual acoustic sensors in a head area, in accordance with various embodiments.

FIG. 17 illustrates various locations 1720-1740 for placing structure 1600 in a head area. As such, structure 1600 can be mounted at positions of the headband stripe described above, corresponding to location 1710, 1730, 1740, and/or other locations not illustrated by FIG. 17. Such locations can be selected based on achieving good contact with a user's forehead and can be associated with good signal pickup associated with, e.g., both air and bone conduction microphones included in structure 1600. Further, FIG. 17 illustrates location 1720 for contacting structure 1600 located on an adjustable elastic band of helmet 1800 described below.

Figure 18:
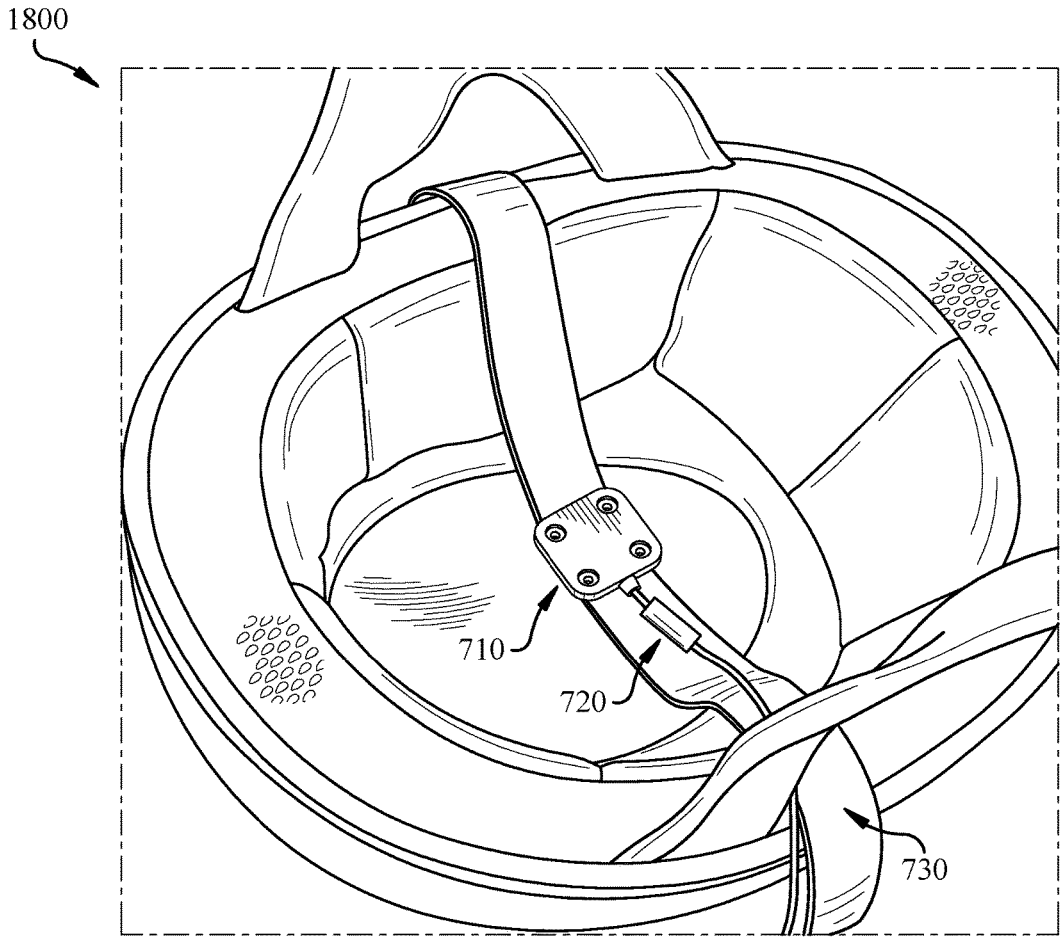
FIG. 18 illustrates yet another dual structure including dual acoustic sensors mounted on a helmet.

FIG. 18 illustrates acoustic sensors mounted on an adjustable elastic band of helmet 1800, in accordance with various embodiments. In another embodiment, bone conduction microphone 710 is sewn or attached to the adjustable elastic band. Further, two ends of the adjustable elastic band are fastened to the helmet using Velcro® or other means. The length of the elastic headband can be adjusted to suit the user's level of comfort, ensuring a good contact of bone conduction microphone 710 with the user.

Figure 19:
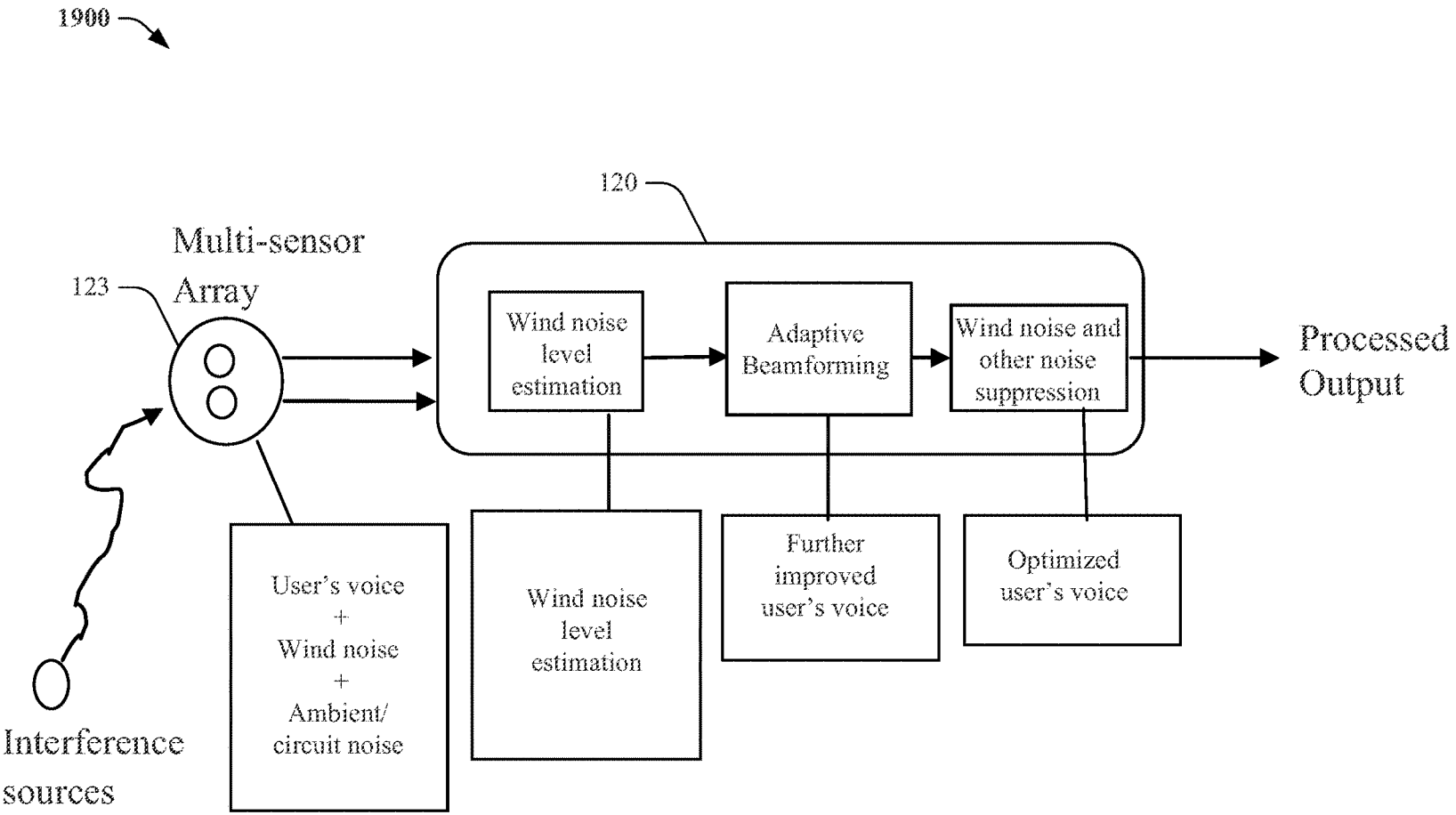
FIG. 19 illustrates a block diagram of another multi-sensor system, in accordance with various embodiments.
Figure 20:
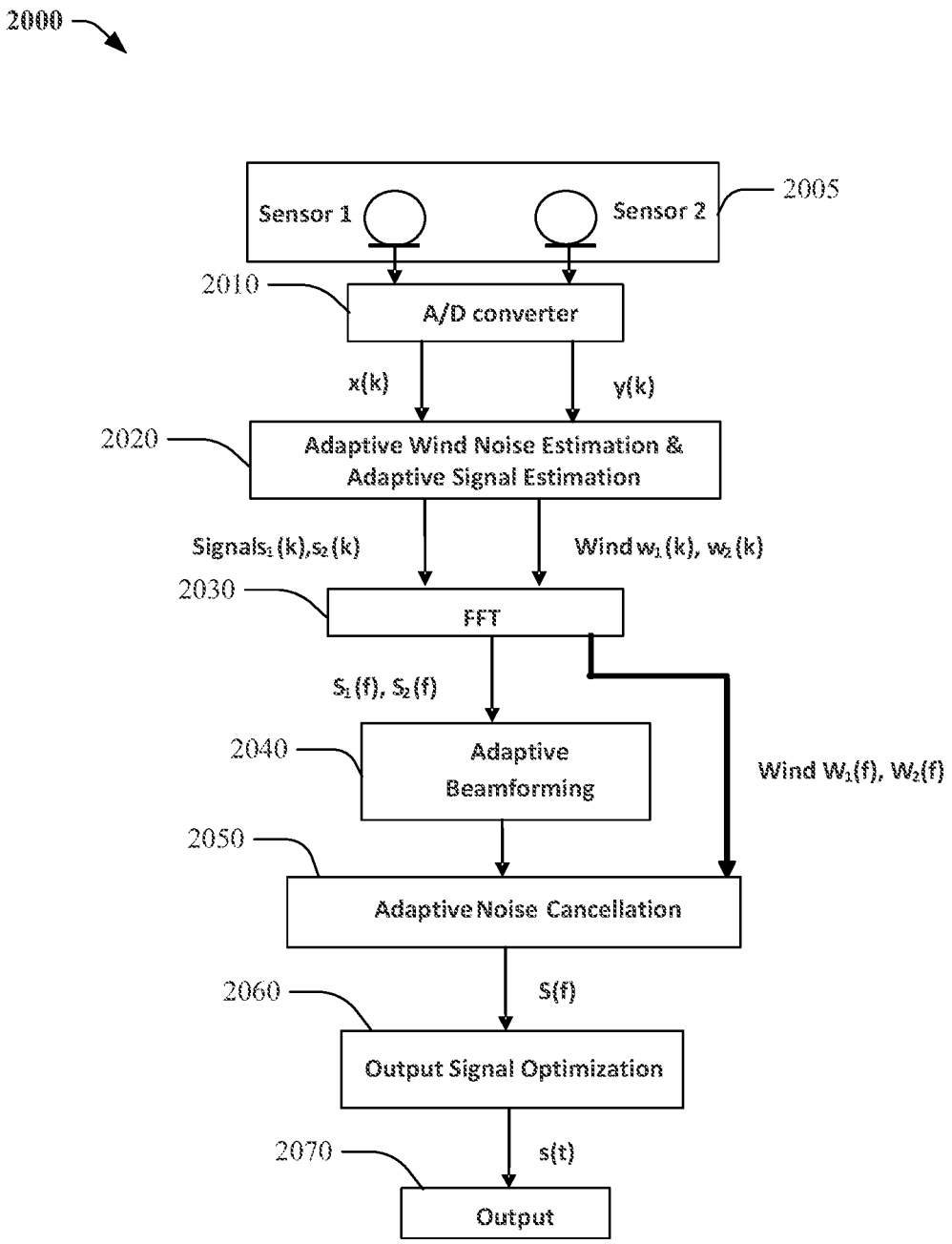
FIG. 20 illustrates various wind noise components associated with a dual acoustic sensor device, in accordance with various embodiments.
Figure 21:
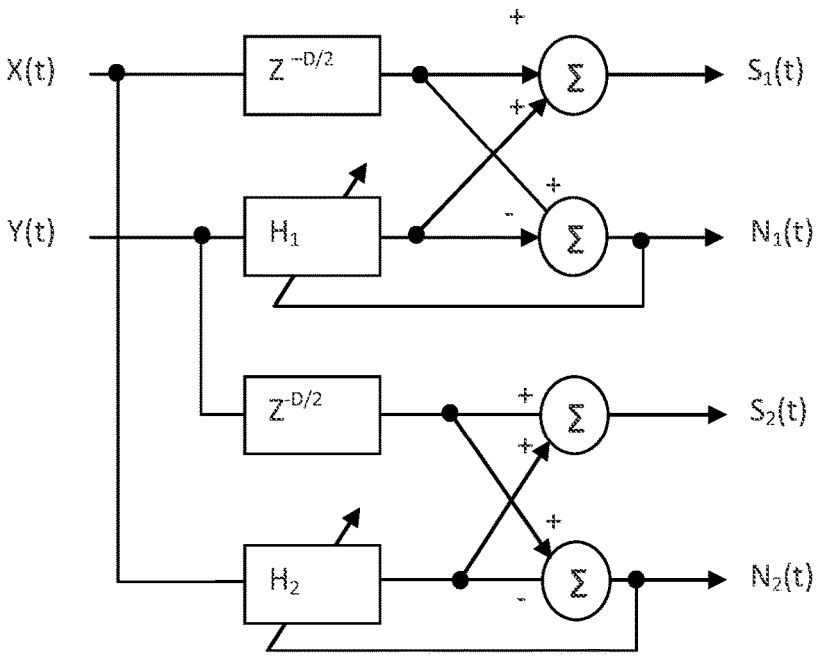
FIG. 21 illustrates an adaptive signal estimator and noise estimator, in accordance with various embodiments.

FIGS. 19-21 illustrate a block diagram of a multi-sensor system 1900, various components/processing steps 2000, and associated functions 2100, respectively, in accordance with various embodiments. At 2005, a multi-sensor array, e.g., 123, can detect sound including a user's voice, wind noise, and ambient/circuit noise and generate sound information based on the sound. At 2010, ADC 124 can convert the sound information into digital data. At 2020 through 2070, various components including an adaptive wind noise estimation adaptive signal estimation component, an FFT component, an adaptive beamforming component, and an adaptive noise cancellation component can perform various processing according to functions 2100. In one embodiment, adaptive wind noise estimation and adaptive signal estimation component 2020 can estimate wind noise impact on one or both of the acoustic sensors of sensor component 123. Further, adaptive noise cancellation component 2050 can cancel, remove, etc. such noise based on an output received from adaptive beamforming component 2040 that is converted to the frequency domain. As such, adaptive noise cancellation component 2050 can further convert such frequency domain data into a Bark Scale. Further, a level of the environmental noise other than wind noise is estimated. At 2060, an output signal optimization component can apply minimization algorithm, e.g., minimization algorithm (9) of algorithms 1350, based on an output of adaptive noise cancellation component 2040.

Figure 22:
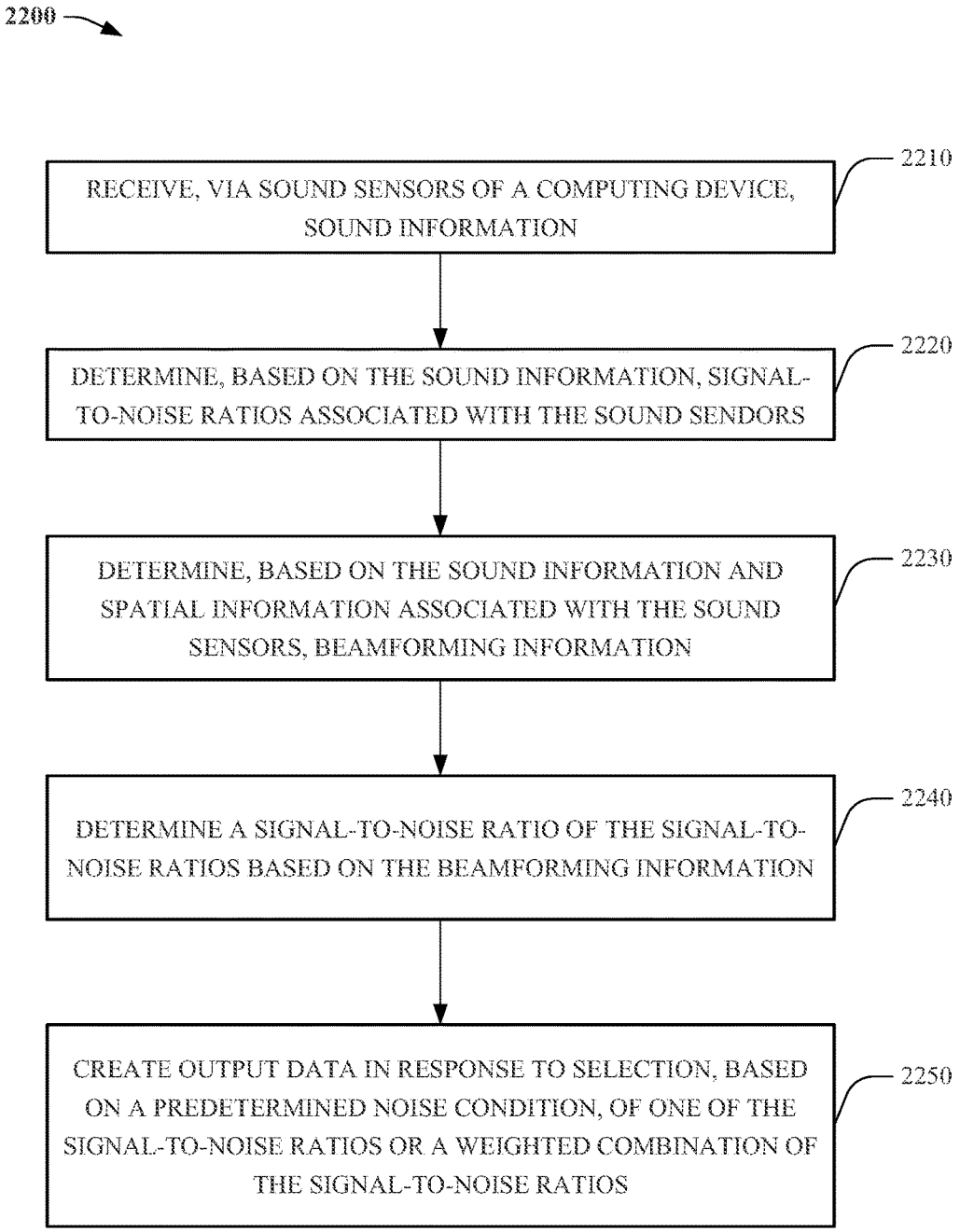
FIG. 22 illustrates a processes associated with one or more dual acoustic sensor devices, in accordance with an embodiment.

FIG. 22 illustrates a methodology in accordance with the disclosed subject matter. For simplicity of explanation, the methodology is depicted and described as a series of acts. It is to be understood and appreciated that the subject innovation is not limited by the acts illustrated and/or by the order of acts. For example, acts can occur in various orders and/or concurrently, and with other acts not presented or described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

Referring now to FIG. 22, a process associated with a multi-sensor device and/or system, e.g., 100, 200, 400, 1200 through 1600, and 1900-2000, etc. is illustrated, in accordance with an embodiment. At 2210, sound information can be received via sound sensors of a computing device. At 2220, SNRs associated with each sound sensor can be determined based on the sound information. At 2230, beamforming information can be determined based on the sound information and spatial information associated with the sound sensors. At 2240, an SNR of the beamforming informing information can be determined. At 2250, output data can be created in response to selection, based on a predetermined noise condition, of one of the SNRs or a weighted combination of the SNRs.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions and/or processes described herein. Processors can exploit nano-scale architectures such as, but not limited to, molecular and quantum-dot based transistors, switches and gates, in order to optimize space usage or enhance performance of mobile devices. A processor may also be implemented as a combination of computing processing units.

In the subject specification, terms such as "store," "data store," "data storage," "database," "storage medium," and substantially any other information storage component relevant to operation and functionality of a component and/or process, refer to "memory components," or entities embodied in a "memory," or components comprising the memory. It will be appreciated that the memory components described herein can be either volatile memory or nonvolatile memory, or can include both volatile and nonvolatile memory.

By way of illustration, and not limitation, nonvolatile memory, for example, can be included in storage systems described above, non-volatile memory 2322 (see below), disk storage 2324 (see below), and memory storage 2346 (see below). Further, nonvolatile memory can be included in read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Figure 23:
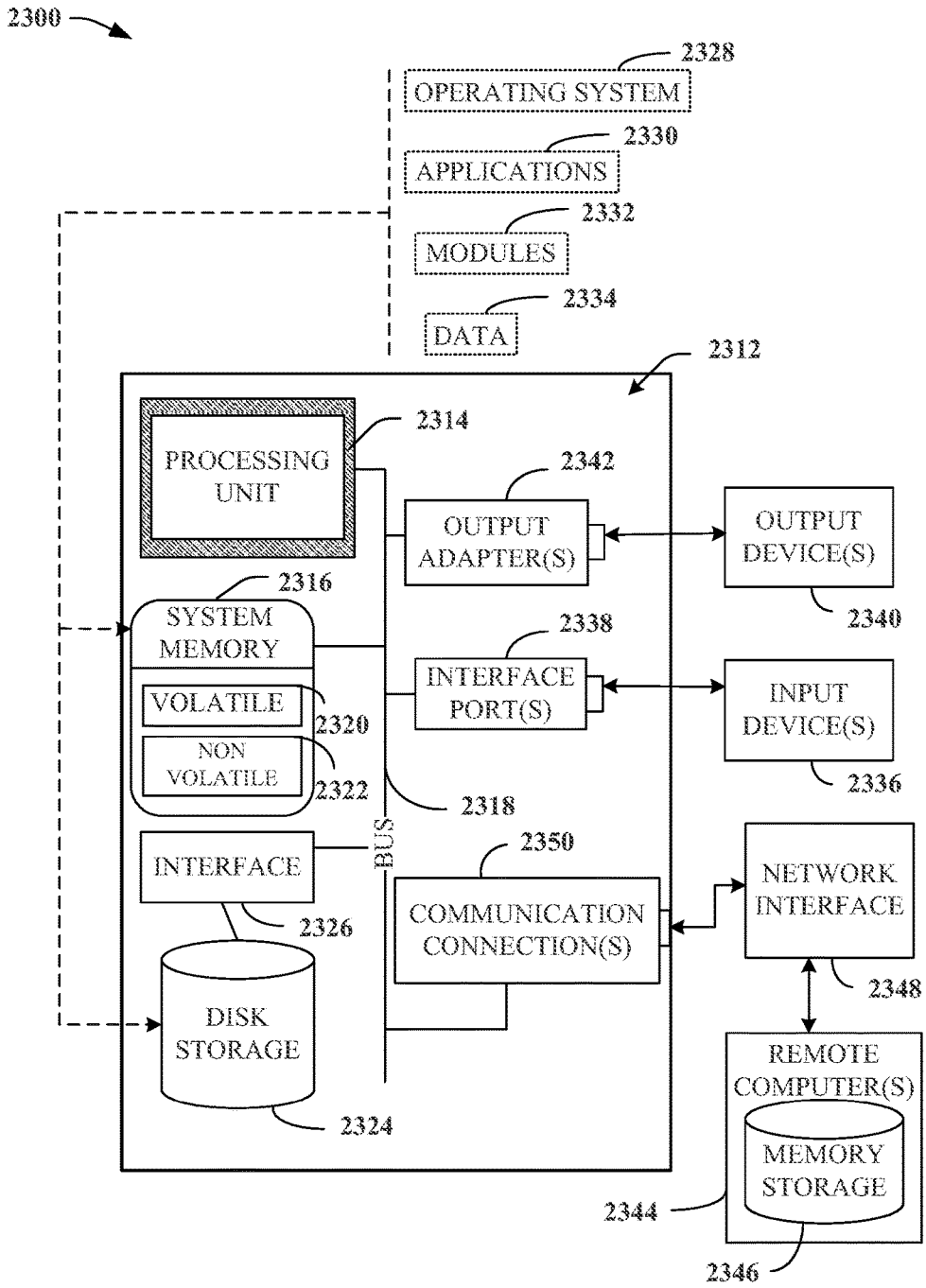
FIG. 23 illustrates a block diagram of a computing system operable to execute the disclosed systems and methods, in accordance with an embodiment.

In order to provide a context for the various aspects of the disclosed subject matter, FIG. 23, and the following discussion, are intended to provide a brief, general description of a suitable environment in which the various aspects of the disclosed subject matter can be implemented, e.g., various processes associated with FIGS. 1-22. While the subject matter has been described above in the general context of computer-executable instructions of a computer program that runs on a computer and/or computers, those skilled in the art will recognize that the subject innovation also can be implemented in combination with other program modules. Generally, program modules include routines, programs, components, data structures, etc. that perform particular tasks and/or implement particular abstract data types.

Moreover, those skilled in the art will appreciate that the inventive systems can be practiced with other computer system configurations, including single-processor or multiprocessor computer systems, mini-computing devices, mainframe computers, as well as personal computers, hand-held computing devices (e.g., PDA, phone, watch), microprocessor-based or programmable consumer or industrial electronics, and the like. The illustrated aspects can also be practiced in distributed computing environments where tasks are performed by remote processing devices that are linked through a communications network; however, some if not all aspects of the subject disclosure can be practiced on stand-alone computers. In a distributed computing environment, program modules can be located in both local and remote memory storage devices.

With reference to FIG. 23, a block diagram of a computing system 2300 operable to execute the disclosed systems and methods is illustrated, in accordance with an embodiment. Computer 2312 includes a processing unit 2314, a system memory 2316, and a system bus 2318. System bus 2318 couples system components including, but not limited to, system memory 2316 to processing unit 2314. Processing unit 2314 can be any of various available processors. Dual microprocessors and other multiprocessor architectures also can be employed as processing unit 2314.

System bus 2318 can be any of several types of bus structure(s) including a memory bus or a memory controller, a peripheral bus or an external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1194), and Small Computer Systems Interface (SCSI).

System memory 2316 includes volatile memory 2320 and nonvolatile memory 2322. A basic input/output system (BIOS), containing routines to transfer information between elements within computer 2312, such as during start-up, can be stored in nonvolatile memory 2322. By way of illustration, and not limitation, nonvolatile memory 2322 can include ROM, PROM, EPROM, EEPROM, or flash memory. Volatile memory 2320 includes RAM, which acts as external cache memory. By way of illustration and not limitation, RAM is available in many forms such as SRAM, dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 2312 can also include removable/non-removable, volatile/non-volatile computer storage media, networked attached storage (NAS), e.g., SAN storage, etc. FIG. 23 illustrates, for example, disk storage 2324. Disk storage 2324 includes, but is not limited to, devices like a magnetic disk drive, floppy disk drive, tape drive, Jaz drive, Zip drive, LS-110 drive, flash memory card, or memory stick. In addition, disk storage 2324 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 2324 to system bus 2318, a removable or non-removable interface is typically used, such as interface 2326.

It is to be appreciated that FIG. 23 describes software that acts as an intermediary between users and computer resources described in suitable operating environment 2300. Such software includes an operating system 2328. Operating system 2328, which can be stored on disk storage 2324, acts to control and allocate resources of computer 2312. System applications 2330 take advantage of the management of resources by operating system 2328 through program modules 2332 and program data 2334 stored either in system memory 2316 or on disk storage 2324. It is to be appreciated that the disclosed subject matter can be implemented with various operating systems or combinations of operating systems.

A user can enter commands or information into computer 2312 through input device(s) 2336. Input devices 2336 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to processing unit 2314 through system bus 2318 via interface port(s) 2338. Interface port(s) 2338 include, for example, a serial port, a parallel port, a game port, and a universal serial bus (USB). Output device(s) 2340 use some of the same type of ports as input device(s) 2336.

Thus, for example, a USB port can be used to provide input to computer 2312 and to output information from computer 2312 to an output device 2340. Output adapter 2342 is provided to illustrate that there are some output devices 2340 like monitors, speakers, and printers, among other output devices 2340, which use special adapters. Output adapters 2342 include, by way of illustration and not limitation, video and sound cards that provide means of connection between output device 2340 and system bus 2318. It should be noted that other devices and/or systems of devices provide both input and output capabilities such as remote computer(s) 2344.

Computer 2312 can operate in a networked environment using logical connections to one or more remote computers, such as remote computer(s) 2344. Remote computer(s) 2344 can be a personal computer, a server, a router, a network PC, a workstation, a microprocessor based appliance, a peer device, or other common network node and the like, and typically includes many or all of the elements described relative to computer 2312.

For purposes of brevity, only a memory storage device 2346 is illustrated with remote computer(s) 2344. Remote computer(s) 2344 is logically connected to computer 2312 through a network interface 2348 and then physically connected via communication connection 2350. Network interface 2348 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 2350 refer(s) to hardware/software employed to connect network interface 2348 to bus 2318. While communication connection 2350 is shown for illustrative clarity inside computer 2312, it can also be external to computer 2312. The hardware/software for connection to network interface 2348 can include, for example, internal and external technologies such as modems, including regular telephone grade modems, cable modems and DSL modems, ISDN adapters, and Ethernet cards.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A system, comprising:

a sensor component including acoustic sensors configured to detect sound and generate, based on the sound, first sound information that has been generated by a first sensor of the acoustic sensors and second sound information that has been generated by a second sensor of the acoustic sensors; and an audio processing component configured to:

determine, based on the first sound information and the second sound information, estimates of respective impacts of wind noise on the first sensor and the second sensor; and generate output sound information based on the estimates of the respective impacts of the wind noise, a spatial filter associated with the acoustic sensors, and a proportionally weighted combination of processes, wherein a first process of the proportionally weighted combination of processes is proportional to a first signal-to-noise-ratio (SNR) for the first sound information, wherein a second process of the proportionally weighted combination of processes is proportional to a second SNR for the second sound information, wherein a third process of the proportionally weighted combination of processes is proportional to a third SNR of beamforming information that has been computed using the first sound information, the second sound information, and spatial information corresponding to the spatial filter, and wherein the beamforming information is associated with a beam corresponding to a predetermined angle associated with positions of the first sensor and the second sensor.

2. The system of claim 1, further comprising:

a transceiver component configured to send the output sound information directed to a communication device via a wireless data connection or a wired data connection.

3. The system of claim 1, further comprising:

a transceiver component configured to receive audio data from a communication device via a wireless data connection or a wired data connection.

4. The system of claim 3, wherein the first sensor is a first microphone positioned at a first location corresponding to a first speaker, and wherein the second sensor is a second microphone positioned at a second location corresponding to a second speaker.

5. The system of claim 3, wherein a first speaker is configured to generate a first sound wave, and wherein a second speaker is configured to generate a second sound wave including a phase that is opposite from another phase of the first sound wave.

6. The system of claim 3, further comprising:

a first tube that is mechanically coupled between a first earplug and a first speaker; and a second tube that is mechanically coupled between a second earplug and a second speaker.

7. The system of claim 3, further comprising:

speakers configured to generate sound waves based on the audio data.

8. The system of claim 1, wherein the acoustic sensors comprise omnidirectional sensors.

9. The system of claim 1, wherein the first sensor is a bone conduction microphone and the second sensor is an air conduction microphone.

10. The system of claim 9, wherein the bone conduction microphone is positioned adjacent to the air conduction microphone within a structure of the system.

11. The system of claim 10, further comprising a foam material positioned between the structure and acoustic sensors.

12. The system of claim 9, further comprising a membrane positioned adjacent to the acoustic sensors.

13. The system of claim 9, wherein the structure includes an air tube configured to at least one of inflate or deflate the structure.

14. The system of claim 1, wherein the acoustic sensors are air conduction microphones.

15. A method, comprising:

receiving, by a computing device via sound sensors of the computing device, sound information comprising first sound information that has been output by a first sound sensor of the sound sensors and second sound information that has been output by a second sensor of the sound sensors;

based on the first sound information and the second sound information, estimating respective impacts of wind noise on the sound sensors; and creating, by the computing device based on a spatial filter that has been applied to the sound sensors and based on the respective impacts of the wind noise on the sound sensors, output data based on a proportionally weighted combination of processes comprising a first process that is proportional to a first signal-to-noise ratio (SNR) for the first sound information, a second process that is proportional to a second SNR for the second sound information, and a third process that is proportional to a third SNR of beamforming information that has been computed using the first sound information, the second sound information, and spatial information that has been output by the spatial filter.

16. The method of claim 15, further comprising:

filtering, by the computing device, a portion of the sound information based on the respective impacts of the wind noise.

17. The method of claim 15, further comprising:

determining, by the computing device, echo information associated with acoustic coupling between the sound sensors and speakers of the computing device; and filtering, by the computing device, a portion of the sound information based on the echo information.

18. A non-transitory computer readable storage medium comprising computer executable instructions that, in response to execution, cause a system including a processor to perform operations, comprising:

receiving first sound data from a first microphone and second sound data from a second microphone;

based on the first sound data and the second sound data, determining respective estimates of wind noise on the first microphone and the second microphone; and based on a proportionally weighted grouping of processes comprising a first process that is proportional to a first signal-to-noise-ratio (SNR) for the first sound data, a second process that is proportional to a second SNR for the second sound data, and a third process that is proportional to a third SNR of beamforming information, generating output data, wherein the first SNR and the second SNR correspond to the respective estimates of the wind noise, and wherein the beamforming information represents a beam corresponding to a predetermined angle associated with positions of the first microphone and the second microphone.

19. The computer-readable storage medium of claim 18, wherein the first microphone is a bone conduction microphone and the second microphone is an air conduction microphone.

20. The non-transitory computer-readable storage medium of claim 18, wherein the microphones are air conduction microphones.

* * * * *